US010913988B2

(12) United States Patent
Shuto et al.

(10) Patent No.: US 10,913,988 B2
(45) **Date of Patent: *Feb. 9, 2021**

(54) HOT-ROLLED STEEL SHEET

(71) Applicant: NIPPON STEEL & SUMITOMO METAL CORPORATION, Tokyo (JP)

(72) Inventors: Hiroshi Shuto, Oita (JP); Natsuko Sugiura, Kimitsu (JP); Mitsuru Yoshida, Himeji (JP); Tatsuo Yokoi, Oita (JP); Masayuki Wakita, Osaka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 104 days.

This patent is subject to a terminal disclaimer.

(21) Appl. No.: 15/551,171

(22) PCT Filed: Feb. 22, 2016

(86) PCT No.: PCT/JP2016/055071

§ 371 (c)(1),
(2) Date: Aug. 15, 2017

(87) PCT Pub. No.: WO2016/133222

PCT Pub. Date: Aug. 25, 2016

(65) Prior Publication Data

US 2018/0044749 A1 Feb. 15, 2018

(30) Foreign Application Priority Data

Feb. 20, 2015 (WO) ..... PCT/JP2015/054876

(51) Int. Cl.
*C21D 9/46* (2006.01)
*C22C 38/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 2211/002; C21D 2211/005; C21D 2211/008; C21D 8/0226; C21D 8/0263; C21D 9/46; C22C 38/00
(Continued)

(56) References Cited

U.S. PATENT DOCUMENTS 4,501,626 A 2/1985 Sudo et al.
6,251,198 B1 6/2001 Koo et al.
(Continued)

FOREIGN PATENT DOCUMENTS

CA 2882333 A1 4/2014
CA 2944863 A1 10/2015
(Continued)

OTHER PUBLICATIONS

Office Action dated May 30, 2018, in Chinese Patent Application No. 201680010703.X, with English translation.
(Continued)

*Primary Examiner* — Jie Yang
(74) *Attorney, Agent, or Firm* — Birch, Stewart, Kolasch & Birch, LLP

(57) ABSTRACT

A hot-rolled steel sheet includes a predetermined chemical composition, and a structure which include, by area ratio, ferrite and bainite in a range of 80% to 98% in total, and martensite in a range of 2% to 10%, in which in the structure, in a case where a boundary having an orientation difference of equal to or greater than 15° is defined as a grain boundary, and an area which is surrounded by the grain boundary, and has an equivalent circle diameter of equal to or greater than
(Continued)

0.3 μm is defined as a grain, the ratio of the grains having an intragranular orientation difference in a range of 5° to 14° is, by area ratio, in a range of 10% to 60%.

10 Claims, 2 Drawing Sheets

(51) Int. Cl.

| | |
|---|---|
| ***C22C 38/14*** | (2006.01) |
| ***C22C 38/28*** | (2006.01) |
| ***C22C 38/26*** | (2006.01) |
| ***C22C 38/12*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/32*** | (2006.01) |
| ***C22C 38/48*** | (2006.01) |
| ***C22C 38/50*** | (2006.01) |

(52) U.S. Cl.
CPC ..... *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/48* (2013.01); *C22C 38/50* (2013.01); *C21D 2211/002* (2013.01); *C21D 2211/005* (2013.01); *C21D 2211/008* (2013.01)

(58) Field of Classification Search
USPC ..... 148/330
See application file for complete search history.

(56) References Cited

U.S. PATENT DOCUMENTS

| | | | |
|---|---|---|---|
| 6,254,698 | B1 | 7/2001 | Koo et al. |
| 6,589,369 | B2 | 7/2003 | Yokoi et al. |
| 7,662,243 | B2 | 2/2010 | Yokoi et al. |
| 7,749,338 | B2 | 7/2010 | Yokoi et al. |
| 8,353,992 | B2 | 1/2013 | Sugiura et al. |
| 2002/0036035 | A1 | 3/2002 | Kashima et al. |
| 2003/0063996 | A1 | 4/2003 | Funakawa et al. |
| 2004/0074673 | A1 | 4/2004 | Funakawa et al. |
| 2005/0150580 | A1 | 7/2005 | Akamizu et al. |
| 2006/0081312 | A1 | 4/2006 | Yokoi et al. |
| 2006/0266446 | A1 | 11/2006 | Yokoi et al. |
| 2009/0050243 | A1 | 2/2009 | Satou et al. |
| 2009/0050244 | A1 | 2/2009 | Nakagawa et al. |
| 2009/0092514 | A1 | 4/2009 | Asahi et al. |
| 2010/0047617 | A1 | 2/2010 | Sugiura et al. |
| 2010/0108200 | A1 | 5/2010 | Futamura et al. |
| 2010/0108201 | A1 | 5/2010 | Yokoi et al. |
| 2010/0319819 | A1 | 12/2010 | Kaneko et al. |
| 2011/0017360 | A1 | 1/2011 | Yoshinaga et al. |
| 2011/0024004 | A1 | 2/2011 | Azuma et al. |
| 2011/0297281 | A1 | 12/2011 | Satou et al. |
| 2012/0012231 | A1 | 1/2012 | Murakami et al. |
| 2012/0018028 | A1 | 1/2012 | Shimamura et al. |
| 2012/0031528 | A1 | 2/2012 | Hayashi et al. |
| 2013/0000791 | A1 | 1/2013 | Takahashi et al. |
| 2013/0087254 | A1 | 4/2013 | Funakawa et al. |
| 2013/0276940 | A1 | 10/2013 | Nakajima et al. |
| 2013/0319582 | A1 | 12/2013 | Yokoi et al. |
| 2014/0000765 | A1 | 1/2014 | Nozaki et al. |
| 2014/0014236 | A1 | 1/2014 | Nozaki et al. |
| 2014/0014237 | A1 | 1/2014 | Yokoi et al. |
| 2014/0027022 | A1 | 1/2014 | Yokoi et al. |
| 2014/0087208 | A1 | 3/2014 | Toda et al. |
| 2014/0110022 | A1* | 4/2014 | Sano ..... C21D 8/0236 148/504 |
| 2014/0255724 | A1 | 9/2014 | Yamanaka et al. |
| 2014/0287263 | A1 | 9/2014 | Kawata et al. |
| 2014/0290807 | A1 | 10/2014 | Goto et al. |
| 2015/0004433 | A1 | 1/2015 | Tanaka et al. |
| 2015/0030879 | A1 | 1/2015 | Kosaka et al. |
| 2015/0071812 | A1 | 3/2015 | Kawano et al. |
| 2015/0101717 | A1 | 4/2015 | Kosaka et al. |
| 2015/0191807 | A1 | 7/2015 | Hanlon et al. |
| 2015/0203949 | A1 | 7/2015 | Yokoi et al. |
| 2015/0218708 | A1 | 8/2015 | Maruyama et al. |
| 2016/0017465 | A1 | 1/2016 | Toda et al. |
| 2017/0349967 | A1 | 12/2017 | Yokoi et al. |
| 2018/0023162 | A1* | 1/2018 | Sugiura ..... C21D 9/46 420/83 |
| 2018/0037967 | A1* | 2/2018 | Sugiura ..... C21D 9/46 |
| 2018/0037980 | A1* | 2/2018 | Wakita ..... C21D 9/46 |
| 2018/0044749 | A1 | 2/2018 | Shuto et al. |
| 2019/0226061 | A1 | 7/2019 | Sano et al. |
| 2019/0233926 | A1 | 8/2019 | Sano et al. |
| 2019/0309398 | A1 | 10/2019 | Sano et al. |

FOREIGN PATENT DOCUMENTS

| | | | |
|---|---|---|---|
| CN | 1450191 | A | 10/2003 |
| CN | 101443467 | A | 5/2009 |
| CN | 101646794 | A | 2/2010 |
| CN | 101724776 | A | 6/2010 |
| CN | 101999007 | A | 3/2011 |
| CN | 103459647 | A | 12/2013 |
| CN | 103459648 | A | 12/2013 |
| CN | 104011234 | A | 8/2014 |
| CN | 107250411 | A | 10/2017 |
| EP | 1149925 | A1 | 10/2001 |
| EP | 1350859 | A1 | 10/2003 |
| EP | 1559797 | A1 | 8/2005 |
| EP | 2088218 | A1 | 8/2009 |
| EP | 2 182 080 | A1 | 5/2010 |
| EP | 2 453 032 | A1 | 5/2012 |
| EP | 2530180 | A1 | 12/2012 |
| EP | 2599887 | A1 | 6/2013 |
| EP | 2631314 | A1 | 8/2013 |
| EP | 2865778 | A1 | 4/2015 |
| JP | 57-70257 | A | 4/1982 |
| JP | 58-42726 | A | 3/1983 |
| JP | 61-217529 | A | 9/1986 |
| JP | 2-149646 | A | 6/1990 |
| JP | 3-180445 | A | 8/1991 |
| JP | 4-337026 | A | 11/1992 |
| JP | 5-59429 | A | 3/1993 |
| JP | 5-163590 | A | 6/1993 |
| JP | 7-90478 | A | 4/1995 |
| JP | 9-49026 | A | 2/1997 |
| JP | 10-195591 | A | 7/1998 |
| JP | 2001-200331 | A | 7/2001 |
| JP | 2001-220648 | A | 8/2001 |
| JP | 2001-303186 | A | 10/2001 |
| JP | 2002-105595 | A | 4/2002 |
| JP | 2002-161340 | A | 6/2002 |
| JP | 2002-226943 | A | 8/2002 |
| JP | 2002-317246 | A | 10/2002 |
| JP | 2002-534601 | A | 10/2002 |
| JP | 2002-322540 | A | 11/2002 |
| JP | 2002-322541 | A | 11/2002 |
| JP | 2003-342664 | A | 12/2003 |
| JP | 2004-218077 | A | 8/2004 |
| JP | 2004-250749 | A | 9/2004 |
| JP | 2004-315857 | A | 11/2004 |
| JP | 2005-82841 | A | 3/2005 |

(56) References Cited

FOREIGN PATENT DOCUMENTS

| | | | |
|---|---|---|---|
| JP | 2005-213566 | A | 8/2005 |
| JP | 2005-220440 | A | 8/2005 |
| JP | 2005-256115 | A | 9/2005 |
| JP | 2005-298924 | A | 10/2005 |
| JP | 2005-320619 | A | 11/2005 |
| JP | 2006-274318 | A | 10/2006 |
| JP | 2007-9322 | A | 1/2007 |
| JP | 2007-138238 | A | 6/2007 |
| JP | 2007-231399 | A | 9/2007 |
| JP | 2007-247046 | A | 9/2007 |
| JP | 2007-247049 | A | 9/2007 |
| JP | 2007-314828 | A | 12/2007 |
| JP | 2008-266726 | A | 11/2008 |
| JP | 2008-285748 | A | 11/2008 |
| JP | 2009-19265 | A | 1/2009 |
| JP | 2009-24227 | A | 2/2009 |
| JP | 2009-191360 | A | 8/2009 |
| JP | 2009-270171 | A | 11/2009 |
| JP | 2009-275238 | A | 11/2009 |
| JP | 2010-168651 | A | 8/2010 |
| JP | 2010-202976 | A | 9/2010 |
| JP | 2010-248601 | A | 11/2010 |
| JP | 2010-255090 | A | 11/2010 |
| JP | 2011-140671 | A | 7/2011 |
| JP | 2011-225941 | A | 11/2011 |
| JP | 2012-26032 | A | 2/2012 |
| JP | 2012-41573 | A | 3/2012 |
| JP | 2012-62561 | A | 3/2012 |
| JP | 2012-180569 | A | 9/2012 |
| JP | 2012-251201 | A | 12/2012 |
| JP | 2013-19048 | A | 1/2013 |
| JP | 5240037 | B2 | 7/2013 |
| JP | 5445720 | B1 | 3/2014 |
| JP | 2014-141703 | A | 8/2014 |
| JP | 5574070 | B1 | 8/2014 |
| JP | 5610103 | B2 | 10/2014 |
| JP | 2015-124411 | A | 7/2015 |
| JP | 2016-50334 | A | 4/2016 |
| JP | 2015-218352 | A | 12/2016 |
| KR | 10-2003-0076430 | A | 9/2003 |
| KR | 10-0778264 | B1 | 11/2007 |
| KR | 10-2009-0086401 | A | 8/2009 |
| TW | 201245465 | A1 | 11/2012 |
| TW | 201332673 | A1 | 8/2013 |
| TW | 201413009 | A | 4/2014 |
| TW | I467027 | B | 1/2015 |
| TW | I470091 | B | 1/2015 |
| WO | WO 2007/132548 | A1 | 11/2007 |
| WO | WO 2008/056812 | A1 | 5/2008 |
| WO | WO 2008/12366 | A1 | 10/2008 |
| WO | WO 2010/131303 | A1 | 11/2010 |
| WO | WO 2013/121963 | A1 | 8/2013 |
| WO | WO 2013/150687 | A1 | 10/2013 |
| WO | WO 2013/161090 | A1 | 10/2013 |
| WO | WO 2014/014120 | A1 | 1/2014 |
| WO | 2014-37595 | A | 2/2014 |
| WO | WO 2014/019844 | A1 | 2/2014 |
| WO | WO 2014/051005 | A1 | 4/2014 |
| WO | WO 2014/171427 | A1 | 10/2014 |

OTHER PUBLICATIONS

International Search Report for PCT/JP2015/054876 (PCT/ISA/210) dated May 19, 2015.
International Search Report for PCT/JP2016/055071 (PCT/ISA/210) dated May 17, 2016.
Taiwanese Office Action issued in TW Patent Application No. 105105214 dated Mar. 23, 2017.
Written Opinion of the International Searching Authority for PCT/JP2016/055071 (PCT/ISA/237) dated May 17, 2016.
Korean Office Action dated Nov. 7, 2018 for corresponding Korean Application No. 10-2017-7023367, with an English translation.
Extended European Search Report dated Dec. 11, 2018, in European Patent Application No. 16752608.6.
Notice of Allowance dated Feb. 26, 2019, in Korean Patent Application No. 10-2017-7023367, with English translation.
"Development of Production Technology for Ultra Fine Grained Steels", Nakayama Steel Works, Ltd., NFG Product Introduction, 2000, total 11 pages, http://www.nakayama-steel.co.jp/menu/product/nfg.html.
Chinese Office Action and Search Report for Application No. 201580076254.4, dated May 30, 2018, with an English translation.
Chinese Office Action and Search Report for Chinese Application No. 201680011657.5, dated Jun. 5, 2018, with English translation.
Chinese Office Action and Search Report, dated Jun. 25, 2018, for Chinese Application No. 201580076157.5, with an English translation of the Office Action.
English translation of the International Preliminary Report on Patentability and Written Opinion dated Aug. 31, 2017, in PCT International Application No. PCT/JP2015/054846.
English translation of the International Preliminary Report on Patentability and Written Opinion of the International Searching Authority (Forms PCT/IB/338, PCT/IB/373 and PCT/ISA/237), dated Feb. 14, 2019, for International Application No. PCT/JP2017/028478.
Extended European Search Report for European Application No. 17837115.9, dated Nov. 28, 2019.
Extended European Search Report dated Aug. 13, 2018, in European Patent Application No. 15882644.6.
Extended European Search Report, dated Aug. 13, 2018, for corresponding European Application No. 15882647.9.
Extended European Search Report, dated Dec. 19, 2018, for European Application No. 16755418.7.
Extended European Search Report, dated Nov. 29, 2019, for European Application No. 17837116.7.
Extended European Search Report, dated Sep. 12, 2018, for European Application No. 15883192.5.
International Preliminary Report on Patentability and English translation of the Written Opinion of the International Searching Authority for International Application No. PCT/JP2017/028477, dated Feb. 14, 2019.
International Preliminary Report on Patentability and Written Opinion of the International Searching Authority (forms PCT/IB/338, PCT/IB/373 and PCT/ISA/237), dated Sep. 8, 2017, for corresponding International Application No. PCT/JP2015/055455, with a Written Opinion translation.
International Search Report (form PCT/ISA/210), dated May 19, 2015, for International Application No. PCT/JP2015/055455, with an English translation.
International Search Report for PCT/JP2015/054846 dated May 19, 2015.
International Search Report for PCT/JP2015/054860 dated May 19, 2015.
International Search Report for PCT/JP2015/055464 dated May 19, 2015.
International Search Report for PCT/JP2016/055074 (PCT/ISA/210) dated May 17, 2016.
International Search Report for PCT/JP2017/028477 (PCT/ISA/210) dated Oct. 31, 2017.
International Search Report for PCT/JP2017/028478 (PCT/ISA/210) dated Oct. 31, 2017.
Katoh et al., Seitetsu Kenkyu, 1984, No. 312, pp. 41-50.
Kimura et al., "Misorientation Analysis of Plastic Deformation of Austenitic Stainless Steel by EBSD and X-Ray Diffraction Methods", Transactions of the Japan Society of Mechincal Engineers. A, vol. 71, No. 712, 2005, pp. 1722-1728.
Korean Notice of Allowance, dated Feb. 26, 2019, for corresponding Korean Application No. 10-2017-7023370, with an English translation.
Korean Office Action for counterpart Korean Application No. 10-2017-7023370, dated Nov. 7, 2018, with an English translation.
Korean Office Action, dated Oct. 12, 2018, for Korean Application No. 10-2017-7024039, with an English translation.
Office Action for TW 105105137 dated Mar. 23, 2017.
Office Action dated Jun. 1, 2018, in Chinese Patent Application No. 201580075484.9.

(56) References Cited

OTHER PUBLICATIONS

Office Action dated Sep. 3, 2018, in Korean Patent Application No. 10-2017-7018427, with English translation.
Sugimoto et al., "Stretch-flangeability of a High-strength TRIP Type Bainitic Sheet Steel", ISIJ International, 2000, vol. 40, No. 9, pp. 920-926.
Taiwanese Office Action issued in TW Patent Application No. 105105213 dated Mar. 23, 2017.
Takahashi, "Development of High Strength Steels for Automobiles", Nippon Steel Technical Report, Jul. 2003, No. 378, pp. 2-7.
U.S. Final Office Action, dated Dec. 10, 2019, for U.S. Appl. No. 15/549,837.
U.S. Final Office Action, dated Sep. 18, 2019, for U.S. Appl. No. 15/549,093.
U.S. Notice of Allowance, dated Dec. 27, 2019, for U.S. Appl. No. 15/551,863.
U.S. Notice of Allowance, dated Jan. 10, 2020, for U.S. Appl. No. 15/549,093.
U.S. Notice of Allowance, dated Sep. 5, 2019, for U.S. Appl. No. 15/551,863.
U.S. Office Action, dated Apr. 29, 2019, for U.S. Appl. No. 15/549,093.
U.S. Office Action, dated Mar. 22, 2019, for U.S. Appl. No. 15/538,404.
U.S. Office Action, dated May 1, 2019, for U.S. Appl. No. 15/551,863.
U.S. Office Action, dated May 31, 2019, for U.S. Appl. No. 15/549,837.
U.S. Office Action, dated Nov. 18, 2019, for U.S. Appl. No. 15/538,404.
Written Opinion of the International Searching Authority for PCT/JP2015/054846 (PCT/ISA/237) dated May 19, 2015.
Written Opinion of the International Searching Authority for PCT/JP2015/054860 (PCT/ISA/237) dated May 19, 2015.
Written Opinion of the International Searching Authorty for PCT/JP2015/055455 (PCT/ISA/237) dated May 19, 2015.
Written Opinion of the International Searching Authority for PCT/JP2016/055074 (PCT/ISA/237) dated May 17, 2016.
Written Opinion of the International Searching Authority for PCT/JP2017/028477 (PCT/ISA/237) dated Oct. 31, 2017.
Written Opinion of the International Searching Authority for PCT/JP2017/028478 (PCT/ISA/237) dated Oct. 31, 2017.
U.S. Notice of Allowance, dated Feb. 12, 2020, for U.S. Appl. No. 15/549,093.
U.S. Office Action, dated Mar. 2, 2020, for U.S. Appl. No. 16/312,222.
U.S. Notice of Allowance, dated Apr. 17, 2020, for U.S. Appl. No. 15/551,863.

* cited by examiner

HOT-ROLLED STEEL SHEET

TECHNICAL FIELD OF THE INVENTION

The present invention relates to a hot-rolled steel sheet excellent in workability, corrosion resistance after coating, and notch fatigue properties, and particularly relates to a hot-rolled steel sheet with a high-strength composite structure excellent in stretch flangeability, corrosion resistance after coating, and notch fatigue properties.

BACKGROUND ART

In recent years, in response to the demand for reduction in weight of various members for the purpose of improving fuel economy of vehicles, reduction in thickness by increasing strength of a steel sheet such as an iron alloy used for the members, and application of light metals such as an Al alloy to the various members have been proceeded. However, as compared with heavy metals such as steel, the light metals such as an Al alloy have an advantage of high specific strength, but are extremely expensive. For this reason, the application of the light metal such as an Al alloy is limited to special applications. Accordingly, in order to apply the reduction in the weight of the various members to a cheaper and wider range, it is necessary to reduce the thickness by increasing the strength of the steel sheet.

When the steel sheet is strengthened, the material properties such as formability (workability) are generally deteriorated. Thus, in the developing of the high-strength steel sheet, it is an important problem to achieve the high strength of the steel sheet without deteriorating the material properties. Particularly, the steel sheet used as vehicle members such as an inner plate member, a structural member, and a suspension member requires stretch-flange formability, burring workability, ductility, fatigue durability, impact resistance, corrosion resistance, and the like depending on the application, and it is important to realize both of these material properties and the strength.

For example, among the vehicle members, the steel sheets used for the structural member, the suspension member, and the like, which account for about 20% of the vehicle body weight are press-formed mainly based on stretch flange processing and burring processing after performing blanking and drilling by shearing or punching. For this reason, excellent stretch flangeability is required for such steel sheets.

With respect to the above-described problem, for example, Patent Document 1 discloses a hot-rolled steel sheet in which a martensite fraction, a size, a number density, and an average martensite gap are specified, and elongation (ductility) and hole expansion are excellent. Patent Document 2 discloses a hot-rolled steel sheet which is obtained by limiting the average grain size of ferrite and a second phase and a carbon concentration of the second phase, and is excellent in burring workability. Patent Document 3 discloses a hot-rolled steel sheet which is obtained by winding at a low temperature after being kept at a temperature in a range of 750° C. to 600° C. for 2 to 15 seconds, and is excellent in workability, surface quality, and flatness.

However, in Patent Document 1, since a primary cooling rate should be set to be equal to or higher than 50° C./s after completing the hot rolling, the load applied on an apparatus increases. In addition, in a case of setting the primary cooling rate to be equal to or higher than 50° C./s, there is a problem in that unevenness in materials is caused by unevenness in the cooling rate.

In addition, as described above, in recent years, the demand for the application of the high-strength steel sheet to the vehicle members have been required. In a case where the high-strength steel sheet is press-formed by cold working, cracks likely to occur at an edge of a portion which is subjected to the stretch flange forming during the forming process. The reason for this is that work hardening occurs only on an edge portion due to the strain which is introduced to a punched end surface at the time of blanking. In the related art, as a method of evaluating a test of the stretch flangeability, a hole expansion test has been used. However, in the hole expansion test, breaking occurs without the strains in the circumferential direction are hardly distributed; however, in the actual process of components, strain distribution is present, and thus a gradient of the strain and the stress in the vicinity of the broken portion affects a breaking limit. Accordingly, regarding the high-strength steel sheet, even if the sufficient stretch flangeability is exhibited in the hole expansion test, in a case of performing cold pressing, the breaking may occur due to the strain distribution.

The techniques disclosed in Patent Documents 1 to 3 disclose that in all of the inventions, the hole expansion is improved by specifying only the structures observed using an optical microscope. However, it is not clear whether or not sufficient stretch flangeability can be secured even in consideration of the strain distribution.

In the vehicle members, in a case where the steel sheet is used for components having a portion with large stress concentration such as a drilling portion, among important safety components such as a wheel and a suspension, it requires notch fatigue properties in addition to the above-described stretch flangeability. Further, the strength and the notch fatigue properties of the component are deteriorated when the sheet thickness is reduced due to the corrosion, and thus the steel used for the components as described above also requires corrosion resistance (corrosion resistance after coating) after chemical conversion and electrodeposition coating.

Regarding the improvement of the notch fatigue properties, it has been reported that it is effective to set the structure to a composite structure having a ferrite and a secondary hard phase for reduction in crack propagation speed. For example, Patent Document 4 discloses a steel sheet in which the fatigue properties of materials without notches and the notch fatigue properties are realized by dispersing hard bainite or martensite in the structure having fine ferrite as a primary phase. However, in Patent Document 4, the stretch flangeability is not disclosed at all.

In addition, in Patent Documents 5 and 6, it has been reported that the crack propagation speed can be reduced by increasing the aspect ratio of martensite in the composite structure. However, the targets for the above-described ones are steel plate, and thus do not have the excellent stretch flangeability required at the time of press forming of steel sheets. For this reason, it is hard to use the steel sheet disclosed in Patent Documents 5 and 6 as a steel sheet for vehicles.

In addition, in Patent Documents 4, 5, and 6, in order to form a composite structure of ferrite and martensite, Si is added for the purpose of prompting ferritic transformation in many cases. However, the steel sheet containing Si had a problem in that a tiger stripe shaped scale pattern called red scale (Si scale) was generated on the surface of the steel sheet, and the corrosion resistance after coating was deteriorated.

As described above, it is difficult to obtain a steel sheet satisfying all of the stretch flangeability, the notch fatigue properties, and the corrosion resistance after coating which are required for vehicle members.

PRIOR ART DOCUMENT

Patent Document

[Patent Document 1] Japanese Unexamined Patent Application, First Publication No. 2013-19048

[Patent Document 2] Japanese Unexamined Patent Application, First Publication No. 2001-303186

[Patent Document 3] Japanese Unexamined Patent Application, First Publication No. 2005-213566

[Patent Document 4] Japanese Unexamined Patent Application, First Publication No. H04-337026

[Patent Document 5] Japanese Unexamined Patent Application, First Publication No. 2005-320619

[Patent Document 6] Japanese Unexamined Patent Application, First Publication No. H07-90478

DISCLOSURE OF THE INVENTION

Problems to be Solved by the Invention

The present invention has been made in consideration of the above described circumstance.

An object of the present invention is to provide a high-strength hot-rolled steel sheet which is excellent in the corrosion resistance after coating, and can be applied to a member that requires strict stretch flangeability and notch fatigue properties. In the present invention, the stretch flangeability means a value evaluated by a product of maximum forming height H (mm) of the flange and tensile strength (MPa) obtained as a result of the test by the saddle type stretch flange test method, which is an index of the stretch flangeability in consideration of the strain distribution, and the excellent stretch flangeability means that the product of the maximum forming height H (mm) and the tensile strength (MPa) is equal to or greater than 19500 (mm·MPa).

Further, the excellent notch fatigue properties means that a ratio FLITS of notch fatigue limit FL (MPa) to tensile strength TS (MPa), which is obtained by a notch fatigue test is equal to or greater than 0.25. In addition, the high strength means that the tensile strength is equal to or greater than 540 MPa. Further, the excellent corrosion resistance after coating means that the maximum exfoliation width which is an index of the corrosion resistance after coating is equal to or less than 4.0 mm.

In addition, in the related art, it has been known that as the stretch flangeability is improved, the ductility is deteriorated. However, the hot-rolled steel sheet of the present invention has the stretch flangeability improved, and can satisfy the expression TS×EL≥13500 MPa·%, which is typical minimum ductility required for the vehicle members.

Means for Solving the Problem

According to the related art, the improvement of the stretch flangeability (hole expansion) has been performed by inclusion control, homogenization of structure, unification of structure, and/or reduction in hardness difference between structures, as disclosed in Patent Documents 1 to 3. In other words, in the related art, hole expansion or the like has been improved by controlling the structure which can be observed using an optical microscope.

In this regard, the present inventors made an intensive study by focusing an intragranular orientation difference in grains in consideration that the stretch flangeability under the presence of the strain distribution cannot be improved even by controlling only the structure observed using an optical microscope. As a result, it was found that it is possible to greatly improve the stretch flangeability by controlling the ratio of the grains in which the intragranular orientation difference is in a range of 5° to 14° with respect to the entire grains to be within a certain range.

The present invention is configured on the basis of the above findings, and the gists thereof are as follows.

(1) A hot-rolled steel sheet according to one aspect of the present invention includes as a chemical composition, by mass %, C: 0.020% to 0.070%, Mn: 0.60% to 2.00%, Al: 0.10% to 1.00%, Ti: 0.015% to 0.170%, Nb: 0.005% to 0.050%, Cr: 0% to 1.0%, V: 0% to 0.300%, Cu: 0% to 2.00%, Ni: 0% to 2.00%, Mo: 0% to 1.00%, Mg: 0% to 0.0100%, Ca: 0% to 0.0100%, REM: 0% to 0.1000%, B: 0% to 0.0100%, Si: limited to equal to or less than 0.100%, P: limited to equal to or less than 0.050%, S: limited to equal to or less than 0.005%, and N: limited to equal to or less than 0.0060%, with the remainder of Fe and impurities; and in which a structure includes, by an area ratio, ferrite and bainite in a range of 80% to 98% in total, and martensite in a range of 2% to 10%, and in which in the structure, in a case where a boundary having an orientation difference of equal to or greater than 15° is defined as a grain boundary, and an area which is surrounded by the grain boundary, and has an equivalent circle diameter of equal to or greater than 0.3 μm is defined as a grain, the ratio of the grains having an intragranular orientation difference in a range of 5° to 14° is, by the area ratio, in a range of 10% to 60%.

(2) In the hot-rolled steel sheet described in the above (1), the chemical composition may contain, by mass %, one or two or more of V: 0.010% to 0.300%, Cu: 0.01% to 1.20%, Ni: 0.01% to 0.60%, and Mo: 0.01% to 1.00%.

(3) In the hot-rolled steel sheet described in the above (1) or (2), the chemical composition may contain, by mass %, one or two or more of Mg: 0.0005% to 0.0100%, Ca: 0.0005% to 0.0100%, and REM: 0.0005% to 0.1000%.

(4) In the hot-rolled steel sheet described in any one of the above (1) to (3), the chemical composition may contain, by mass %, B: 0.0002% to 0.0020%.

(5) In the hot-rolled steel sheet described in any one of the above (1) to (4), a tensile strength may be equal to or greater than 540 MPa, and a product of the tensile strength and a maximum forming height in a saddle type stretch flange test may be equal to or greater than 19500 mm·MPa.

Effects of the Invention

According to the above-described aspects of the present invention, it is possible to provide a high-strength hot-rolled steel sheet which has high strength, can be applied to a member that requires strict stretch flangeability, and is excellent in the stretch flangeability, the notch fatigue properties, and the corrosion resistance after coating.

EMBODIMENTS OF THE INVENTION

Figure 1:
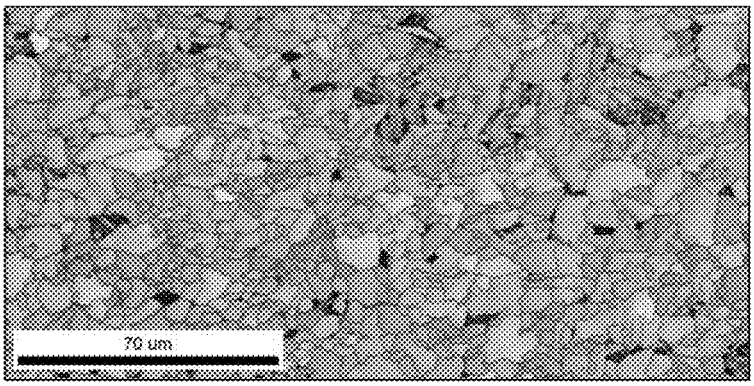
FIG. 1 is an analysis result obtained by EBSD at t/4 portion (a ¼ thickness position from the surface in the sheet thickness direction) of a hot-rolled steel sheet according to the present embodiment.

Hereinafter, a hot-rolled steel sheet (hereinafter, referred to as a hot-rolled steel sheet according to the present embodiment in some case) of the embodiment of the present invention will be described in detail.

The hot-rolled steel sheet according to the present embodiment includes, as a chemical composition, by mass %, C: 0.020% to 0.070%, Mn: 0.60% to 2.00%, Al: 0.10% to 1.00%, Ti: 0.015% to 0.170%, Nb: 0.005% to 0.050%, and optionally one or more of Cr: equal to or less than 1.0%, V: equal to or less than 0.300%, Cu: equal to or less than 2.00%, Ni: equal to or less than 2.00%, Mo: equal to or less than 1.00%, Mg: equal to or less than 0100%, Ca: equal to or less than 0.0100%, REM: equal to or less than 0.1000%, B: equal to or less than 0.0100%, Si: limited to equal to or less than 0.100%, P: limited to equal to or less than 0.050%, S: limited to equal to or less than 0.005%, and N: limited to equal to or less than 0.0060%, with the remainder of Fe and impurities; and a structure which includes, by area ratio, ferrite and bainite in a range of 80% to 98% in total, and martensite in a range of 2% to 10%, and in the structure, in a case where a boundary having an orientation difference of equal to or greater than 15° is defined as a grain boundary, and an area which is surrounded by the grain boundary, and has an equivalent circle diameter of equal to or greater than 0.3 μm is defined as a grain, the ratio of the grains having an intragranular orientation difference in a range of 5° to 14° is, by area ratio, in a range of 10% to 60%.

First, the reason for limiting the chemical composition of the hot-rolled steel sheet according to the present embodiment will be described. The amount (%) of the respective elements is based on mass %.

C: 0.020% to 0.070%

C is an element which forms a precipitate in the steel sheet by being bonded to Nb, Ti, and the like, and contributes to improvement of the strength of steel by precipitation strengthening. Further, C greatly affects the generation of martensite. For this reason, the lower limit of the C content is set to 0.020%. The lower limit of the C content is preferably 0.025%, and the lower limit of the C content is further preferably 0.030%. On the other hand, when the C content is greater than 0.070%, the stretch flangeability and the weldability are deteriorated. Thus, the upper limit of the C content is set to 0.070%. The upper limit of the C content is preferably 0.065%, and the upper limit of the C content is preferably 0.060%.

Si: equal to or less than 0.100%

Si is an element which decreases a melting point of a scale, and increases adhesion between the scale and a base steel base metal (base material). When the Si content is increased, a scale pattern occurs and chemical convertibility is deteriorated, which causes the corrosion resistance after coating to be deteriorated. For this reason, the Si content is required to be limited. When the Si content is greater than 0.100%, the corrosion resistance after coating is remarkably deteriorated. Thus, the Si content is limited to be equal to or less than 0.100%. The upper limit of the Si content is preferably 0.050%, and the upper limit of the Si content is further preferably 0.040%. The Si content may be 0%.

Mn: 0.60% to 2.00%

Mn is an element which contributes to the improvement of the strength of steel by the solid solution strengthening and/or improving the hardenability of the steel. In order to obtain the aforementioned effect, the lower limit of the Mn content is set to 0.60%. The lower limit of the Mn content is preferably 0.70%, and the lower limit of the Mn content is further preferably 0.80%. On the other hand, when the Mn content is greater than 2.00%, the stretch flangeability is deteriorated. For this reason, the upper limit of the Mn content is set 2.00%. The upper limit of the Mn content is preferably 1.50%, and is further preferably the upper limit of the Mn content is 1.20%.

Al: 0.10% to 1.00%

Al is an effective element as a deoxidizing agent of molten steel. In addition, in the hot-rolled steel sheet according to the present embodiment, Al is an element having an effect of controlling the ratio of the grains having the intragranular orientation difference in a range of 5° to 14° to be in a range of 10% to 60%. It is considered that the aforementioned effect is related to the fact that Al has an effect of greatly increasing a temperature Ar3 of the steel sheet, and thus when Al is contained, the transformation strain introduced in the grain is decreased. In order to obtain such effects, the lower limit of the Al content is set to 0.10%. The lower limit of the Al content is preferably 0.13%, and the lower limit of the Al content is further preferably 0.15%. On the other hand, the Al content is greater than 1.00%, the toughness and the ductility are remarkably deteriorated, and thus breaking may occur during the rolling. For this reason, the upper limit of the Al content is set to 1.00%. The upper limit of the Al content is preferably 0.50%, and the upper limit of the Al content is further preferably 0.40%.

Ti: 0.015% to 0.170%

Ti is an element which is finely precipitated in the steel as carbide and improves the strength of steel by precipitation strengthening. In addition, Ti is an element for forming carbide (TiC) so as to fix C, and limit the generation of cementite which is harmful to the stretch flangeability. In order to obtain the above-described effects, the lower limit of the Ti content is set to 0.015%. The lower limit of the Ti content is preferably 0.020%, and the lower limit of the Ti content is further preferably 0.025%. On the other hand, when the Ti content is greater than 0.170%, the ductility is deteriorated. For this reason, the upper limit of the Ti content is set to 0.170%. The upper limit of the Ti content is preferably 0.150%, and the upper limit of the Ti content is further preferably 0.130%.

Nb: 0.005% to 0.050%

Nb is an element which is finely precipitated in the steel as carbide and improves the strength of steel by precipitation strengthening. In addition, Nb is an element for forming carbide (NbC) so as to fix C, and limit the generation of cementite which is harmful to the stretch flangeability. In order to obtain the above-described effects, the lower limit of the Nb content is set to 0.005%. The lower limit of the Nb content is preferably 0.010%, and the lower limit of the Nb content is further preferably 0.015%. On the other hand, when the Nb content is greater than 0.050%, the ductility is deteriorated. For this reason, the upper limit of the Nb content is set to 0.050%. The upper limit of the Nb content is preferably 0.040%, and the upper limit of the Nb content is further preferably 0.030%.

P: equal to or less than 0.050%

P is an impurity. P causes the toughness, the workability, and the weldability to be deteriorated, and thus the less the content, the better. However, in a case where the P content is greater than 0.050%, the stretch flangeability is remarkably deteriorated, and thus the P content may be limited to be equal to or less than 0.050%. The P content is further preferably equal to or less than 0.030%. Although, there is no need to particularly determine the lower limit of the P content, excessive reduction of the P content is undesirable from the viewpoint of manufacturing cost, and thus the lower limit of the P content may be equal to or greater than 0.005%.

S: equal to or less than 0.005%

S is an element which is not only causes cracks at the time of hot rolling, but also forms an A type inclusion which makes the stretch flangeability deteriorated. For this reason, the less the S content, the better. However, when the S content is greater than 0.005%, the stretch flangeability is remarkably deteriorated, and thus the upper limit of the S content may be limited to be 0.005%. The S content is further preferably equal to or less than 0.003%. Although, there is no need to particularly determine the lower limit of the S content, excessive reduction of the S content is undesirable from the viewpoint of manufacturing cost, and thus the lower limit of S content may be equal to or greater than 0.001%.

N: equal to or less than 0.0060%

N is an element which forms a precipitate with Ti, Nb in preference to C, and decreases Ti and Nb effective for fixing C. For this reason, the less the N content, the better. However, in a case where the N content is greater than 0.0060%, the stretch flangeability is remarkably deteriorated, and thus the upper limit of the N content is limited to be 0.0060%. The N content is further preferably equal to or less than 0.0050%.

The above-described elements are base elements contained in the hot-rolled steel sheet according to the present embodiment, and a chemical composition which contains such base elements, with the remainder of Fe and impurities is a base composition of the hot-rolled steel sheet according to the present embodiment. However, in addition to the base elements (instead of a portion of Fe of the remainder), the hot-rolled steel sheet according to the present embodiment further contains, if necessary, one or more selected from the chemical composition of Cr, V, Cu, Ni, Mo, Mg, Ca, REM, and B (selective elements) within a range described below. It is not necessary to contain the following elements, and thus the lower limit of the content is 0%. Even when such selective elements are unavoidably contaminated in the steel, the effect in the present embodiment is not impaired.

Here, the impurities are elements contaminated in the steel, which are caused from raw materials such as ore and scrap at the time of industrially manufacturing the alloy, or caused by various factors in the manufacturing process, and are in an allowable range which does not adversely affect the properties of the hot-rolled steel sheet according to the present embodiment.

Cr: 0 to 1.0%

Cr is an element which contributes to improvement of the strength of the steel sheet. In a case of obtaining such an effect, the Cr content is preferably equal to or greater than 0.05%. On the other hand, when the Cr content is greater than 1.0%, the effect is saturated and the economic efficiency is deteriorated. Accordingly, even in a case of containing Cr, the upper limit of the Cr content is preferably 1.0%.

V: 0% to 0.300%

V is an element which improves the strength of the steel sheet by the precipitation strengthening or solid solution strengthening. In a case of obtaining such an effect, the V content is preferably equal to or greater than 0.010%. On the other hand, when the V content is greater than 0.300%, the effect is saturated and the economic efficiency is deteriorated. Accordingly, even in the case of containing V, the upper limit of the V content is preferably set to 0.300%.

Cu: 0% to 2.00%

Cu is an element which improves the strength of the steel sheet by the precipitation strengthening or the solid solution strengthening. In a case of obtaining such an effect, the Cu content is preferably equal to or greater than 0.01%. On the other hand, when the Cu content is greater than 2.00%, the effect is saturated and the economic efficiency is deteriorated. Accordingly, even in a case of containing Cu, the upper limit of the Cu content is preferably set to 2.00%. However, when the Cu content is greater than 1.20%, defects due to the scale may occur on the surface of the steel sheet. Accordingly, the upper limit of the Cu content is preferably set to 1.20%.

Ni: 0% to 2.00%

Ni is an element which improves the strength of the steel sheet by the precipitation strengthening or the solid solution strengthening. In a case of obtaining such an effect, the Ni content is preferably equal to or greater than 0.01%. On the other hand, when the Ni content is greater than 2.00%, the effect is saturated and the economic efficiency is deteriorated. In addition, the ductility is also greatly deteriorated. Accordingly, even in the case of containing Ni, the upper limit of the Ni content is preferably set to 2.00%. When the Ni content is greater than 0.60%, the ductility starts to be deteriorated, and thus the upper limit of the Ni content is preferably set to 0.60%.

Mo: 0% to 1.00%

Mo is an element which improves the strength of the steel sheet by the precipitation strengthening or the solid solution strengthening. In a case of obtaining such an effect, the Mo content is preferably equal to or greater than 0.01%. On the other hand, when the Mo content is greater than 1.00%, the effect is saturated and the economic efficiency is deteriorated. Accordingly, even in the case of containing Mo, the upper limit of the Mo content is preferably set to 1.00%.

Mg: 0% to 0.0100%

Mg is an element which improves the workability of the steel sheet by controlling the form of nonmetallic inclusions that become the starting point of breaking and causes deterioration of the workability. In a case of obtaining such an effect, the Mg content is preferably equal to or greater than 0.0005%. On the other hand, when the Mg content is greater than 0.0100%, the effect is saturated and the economic efficiency is deteriorated. Accordingly, even in the case of containing Mg, the upper limit of the Mg content is preferably set to 0.0100%.

Ca: 0% to 0.0100%

Ca is an element which improves the workability of the steel sheet by controlling the form of nonmetallic inclusions that become the starting point of breaking and causes deterioration of the workability. In a case of obtaining such an effect, the Ca content is equal to or greater than 0.0005%. On the other hand, when the Ca content is greater than 0.0100%, the effect is saturated and the economic efficiency is deteriorated. Accordingly, even in the case of containing Ca, the upper limit of the Ca content is preferably set to 0.0100%.

REM: 0% to 0.1000%

REM (rare earth element) is an element which improves the workability of the steel sheet by controlling the form of nonmetallic inclusions that become the starting point of breaking and causes deterioration of the workability. In a case of obtaining such an effect, the REM content is preferably equal to or greater than 0.0005%. On the other hand, when the REM content is greater than 0.1000%, the effect is saturated and the economic efficiency is deteriorated. Accordingly, even in a case of containing REM, the upper limit of the REM content is preferably set to 0.1000%.

B: 0% to 0.0100%

B is an element which is segregated in the grain boundary and improves toughness at a low temperature by enhancing the strength of the grain boundary. In a case of obtaining such an effect, the B content is preferably equal to or greater than 0.0002%. On the other hand, when the B content is greater than 0.0100%, the effect is saturated and the economic efficiency is deteriorated. Accordingly, even in the case of containing B, the upper limit of the B content is preferably set to 0.0100%. In addition, B is an element for strongly improving the hardenability, and when the B content is greater than 0.0020%, the grain ratio having the intragranular orientation difference in a range of 5% to 14° is greater than 60% by area ratio. Accordingly, the upper limit of the B content is preferably set to 0.0020%.

The above-described elements may be contained in the range which does not impair the effect in the present embodiment. For example, the present inventors have confirmed that Sn, Zr, Co, Zn, and W do not impair the effect in the present embodiment even when those are contained by equal to or less than 1% in total. Among those elements, Sn is preferably equal to or less than 0.05% from the aspect that defects may occur at the time of the hot rolling.

Next, the structure (metallographic structure) of the hot-rolled steel sheet according to the present embodiment will be described.

It is necessary that the hot-rolled steel sheet according to the present embodiment contain, by area ratio, ferrite and bainite in a range of 80% to 98% in total, and martensite in a range of 2% to 10%, in the structure observed using an optical microscope. With such a structure, it is possible to improve the strength and the stretch flangeability in well balance. When the total amount of the ferrite and the bainite is less than 80% by area ratio, the balance between the strength and the stretch flangeability is deteriorated, and thus H×TS which is a product of maximum forming height H (mm) and tensile strength TS (MPa) is 19500 mm·MPa. In addition, when the total area ratio of the ferrite and the bainite is greater than 98%, or the area ratio of the martensite is less than 2%, the notch fatigue properties are deteriorated, and thus the relationship expressed by FL/TS≥0.25 cannot be satisfied. Further, when the area ratio of martensite is greater than 10%, the stretch flangeability is deteriorated. Although each of the fraction (the area ratio) of the ferrite and the bainite is not necessarily limited, when the fraction of the bainite is greater than 80%, the ductility may be deteriorated, and thus the fraction of the bainite is preferably equal to or less than 80%, and is further preferably less than 70%.

The structure of the remainder other than ferrite, bainite, and martensite is not particularly limited, and for example, it may be residual austenite, pearlite, or the like. However, the ratio of the remainder is preferably equal to or less than 10% by area ratio in order to limit the deterioration of the stretch flangeability.

The structure fraction (the area ratio) can be obtained using the following method. First, a sample collected from the hot-rolled steel sheet is etched using nital. After etching, a structure photograph obtained at a ¼ thickness position in a visual field of 300 μm×300 μm using an optical microscope is subjected to image analysis, and thereby the area ratio of ferrite and pearlite, and the total area ratio of bainite and martensite are obtained. Then, with a sample etched by LePera solution, the structure photograph obtained at a ¼ thickness position in the visual field of 300 μm×300 μm is subjected to the image analysis using the optical microscope, and thereby the total area ratio of residual austenite and martensite is calculated.

Further, with a sample obtained by grinding the surface to a depth of ¼ thickness from in normal direction of the rolled surface, the volume fraction of the residual austenite is obtained through X-ray diffraction measurement. The volume fraction of the residual austenite is equivalent to the area ratio, and thus is set as the area ratio of the residual austenite.

With such a method, it is possible to obtain the area ratio of each of ferrite, bainite, martensite, residual austenite, and pearlite.

In the hot-rolled steel sheet according to the present embodiment, it is necessary to further control the structure observed using the optical microscope to be within the above-described range, and to control the ratio of the grains having the intragranular orientation difference in a range of 5° to 14°, obtained using an EBSD method (electron beam back scattering diffraction pattern analysis method) frequently used for the crystal orientation analysis. Specifically, in a case where the grain boundary is defined as a boundary having the orientation difference of equal to or higher than 15°, and an area which is surrounded by the grain boundary, and has an equivalent circle diameter of equal to or greater than 0.3 μm is defined as a grain, the ratio of the grains having the intragranular orientation difference in a range of 5° to 14° is set to be in a range of 10% to 60% by area ratio, with respect to the entire grains.

The grains having the above intragranular orientation difference are effective to obtain a steel sheet which has the strength and the workability in the excellent balance, and thus when the ratio is controlled, it is possible to greatly improve the stretch flangeability while maintaining an intended steel sheet strength. When the ratio of the grains having the intragranular orientation difference in a range of 5° to 14° is less than 10% by area ratio, the stretch flangeability is deteriorated. In addition, when the ratio of the grains having the intragranular orientation difference in a range of 5° to 14° is greater than 60% by area ratio, the ductility is deteriorated.

It is considered that the intragranular orientation difference is related to a dislocation density contained in the grains. Typically, the increase in the intragranular dislocation density causes the workability to be deteriorated while bringing about the improvement of the strength. However, in the grain in which the intragranular orientation difference is controlled to be in a range of 5° to 14°, it is possible to improve the strength without deteriorating the workability. For this reason, in the hot-rolled steel sheet according to the present embodiment, the ratio of the grains having the intragranular orientation difference in a range of 5° to 14° is controlled to be in a range of 10% to 60%. The grains having the intragranular orientation difference of less than 5° are excellent in the workability, but are hard to be highly strengthened, and the grains having the intragranular orientation difference of greater than 14° are different in deformability from each other, and thus do not contribute to the improvement of the stretch flangeability.

The ratio of the grains having the intragranular orientation difference in a range of 5° to 14° can be measured by the following method.

First, regarding a vertical section of a position of depth of ¼ (t/4 portion) thickness t from surface of the steel sheet in a rolling direction, an area of 200 μm in the rolling direction, and 100 μm in the normal direction of the rolled surface is subjected to EBSD analysis at a measurement gap of 0.2 μm so as to obtain crystal orientation information. Here, the EBSD analysis is performed using an apparatus which is configured to include a thermal field emission scanning electron microscope (JSM-7001F, manufactured by JEOL) and an EBSD detector (HIKARI detector manufactured by TSL), at an analysis speed in a range of 200 to 300 points per second. Then, with respect to the obtained crystal orientation information, an area having the orientation difference of equal to or greater than 15° and an equivalent circle diameter of equal to or greater than 0.3 μm is defined as grain, an average intragranular orientation difference of the grains is calculated, and the ratio of the grains having the intragranular orientation difference in a range of 5° to 14° is obtained. The grain and the average intragranular orientation difference defined as described above can be calculated using software "OIM Analysis (trademark)" attached to an EBSD analyzer.

The "intragranular orientation difference" of the present invention means "Grain Orientation Spread (GOS)" which is an orientation dispersion in the grains, and the value thereof is obtained as an average value of reference crystal orientations and misorientations of all of the measurement points within the same grain as disclosed in Non-Patent Document 1. In the present embodiment, the reference crystal orientation is an orientation obtained by averaging all of the measurement points in the same grain, a value of GOS can be calculated using "OIM Analysis (trademark) Version 7.0.1" which is software attached to the EBSD analyzer.

FIG. 1 is an EBSD analysis result of an area of 100 μm×100 μm on the vertical section in the rolling direction, which is t/4 portion of the hot-rolled steel sheet according to the present embodiment. In FIG. 1, an area which is surrounded by the grain boundary having the orientation difference of equal to or greater than 15°, and has the intragranular orientation difference in a range of 5° to 14° is shown in black.

Figure 2:
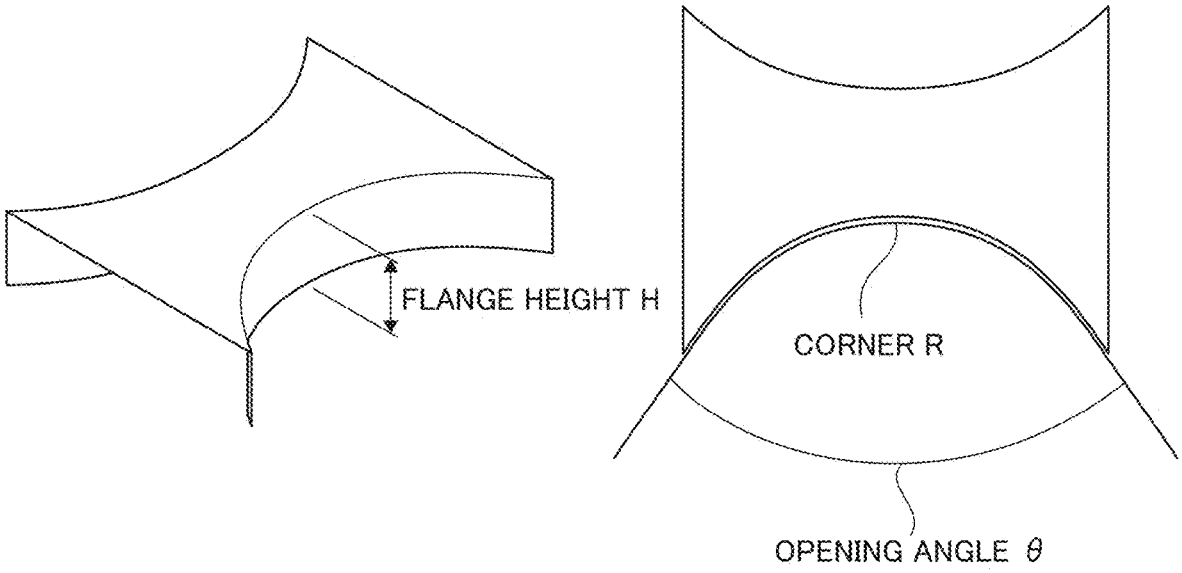
FIG. 2 is a diagram showing a shape of a saddle-shaped formed product which is used in a saddle type stretch flange test method.

In the present embodiment, the stretch flangeability is evaluated using the saddle type stretch flange test method in which the saddle-shaped formed product is used. Specifically, the saddle-shaped formed product simulating the stretch flange shape formed of a linear portion and an arc portion as shown in FIG. 2 is pressed, and the stretch flangeability is evaluated by a maximum forming height at this time. In the saddle type stretch flange test of the present embodiment, the maximum forming height H (mm) when the clearance at the time of punching a corner portion is set to 11% is measured using the saddle-type formed product in which a radius of curvature R of a corner is set to be in a range of 50 to 60 mm, and an opening angle θ is set to 120°. Here, the clearance indicates the ratio of a gap between a punching die and a punch, and the thickness of the test piece. Actually, the clearance is determined by combination of a punching tool and the sheet thickness, and thus the value of 11% means that clearance satisfies a range of 10.5% to 11.5%. The existence of the cracks having a length of ⅓ of the sheet thickness are visually observed after forming, and then a forming height of the limit in which the cracks are not present is determined as the maximum forming height.

In a hole expansion test which is used as a test method corresponding to the stretch flange formability in the related art, the breaking occurs without strains are mostly distributed in the circumferential direction, and thus the strain and the gradient of stress in the vicinity of the broken portion during hole expansion test are different from that in the case of actually forming the stretch flange. In addition, in the hole expansion test, the evaluation does not reflect the original stretch flange forming, since, for example, the evaluation is performed when the rupture of the thickness penetration occurred. On the other hand, in the saddle type stretch flange test used in the present embodiment, it is possible to evaluate the stretch flangeability in consideration of the strain distribution, and thus an evaluation reflecting the original stretch flange forming can be performed.

In the hot-rolled steel sheet according to the present embodiment, the area ratio of each of the structures of the ferrite and bainite which are observed using the optical microscope is not directly related to the ratio of the grains having the intragranular orientation difference in a range of 5° to 14°. In other words, for example, even if there is a hot-rolled steel sheet in which ferrite and bainite have the area ratio as each other, the ratio of the grains having the intragranular orientation difference in a range of 5° to 14° is not necessarily the same. Accordingly, it is not possible to obtain properties corresponding to the hot-rolled steel sheet according to the present embodiment only by controlling the ferrite area ratio, the bainite area ratio, and the martensite area ratio. Details for this will be also described in Examples below.

The hot-rolled steel sheet according to the present embodiment can be obtained using a manufacturing method including a hot rolling process and a cooling process as follows.

<Regarding Hot Rolling Process>

In the hot rolling process, the hot-rolled steel sheet is obtained through the hot rolling after heating a slab having the above-described chemical composition. The slab heating temperature is preferably in a range of SRTmin° C., expressed by the following Expression (a), to 1260° C.

$$SRTmin=7000/\{2.75-\log([Ti]\times[C])\}-273 \quad (a)$$

Here, [Ti] and [C] in Expression (a) indicate the amounts of Ti and C, by mass %.

The hot-rolled steel sheet according to the present embodiment contains Ti, and when the slab heating temperature is lower than SRTmin° C., Ti is not sufficiently solutionized. When Ti is not solutionized at the time of heating the slab, it is difficult that the Ti is finely precipitated as carbide (TiC) so as to improve the strength of steel by the precipitation strengthening. In addition, it is difficult to fix C by forming carbide (TiC), and to limit the generation of cementite harmful to the stretch flangeability. On the other hand, when the heating temperature is equal to or higher than 1260° C. in the slab heating process, the yield is decreased due to the scale off, and thus the heating temperature is preferably set to be equal to or lower than 1260° C.

In a case where the ratio of the grains having the intragranular orientation difference in a range of 5° to 14° is set to be in a range of 10% to 60%, in the hot rolling performed on the heated slab, it is effective to set cumulative strains in a latter part (last three passes) of finish rolling to be in a range of 0.5 to 0.6, and then perform cooling described below. The reason for this is that the grain having the intragranular orientation difference in a range of 5° to 14° is generated by being transformed at a relatively low temperature in a para-equilibrium state, and thus it is possible to control the generation of grain having the intragranular orientation difference in a range of 5° to 14° by limiting the dislocation density of austenite before the transformation to be in a certain range and limiting the cooling rate after transformation to be in a certain range.

In other words, when the cumulative strain at the three passes in the latter part in the finish rolling, and the subsequent cooling are controlled, the grain nucleation frequency of the grain having the intragranular orientation difference in a range of 5° to 14°, and the subsequent growth rate can be controlled, and thus it is possible to control the volume fraction which is obtained as a result. More specifically, the dislocation density of austenite introduced during the finish rolling is mainly related to the nucleation frequency, and the cooling rate after rolling is mainly related to the growth rate.

When the cumulative strain at the three passes in the latter part in the finish rolling is less than 0.5, the dislocation density of austenite to be introduced is not sufficient, and the ratio of the grains having the intragranular orientation difference in a range of 5° to 14° is less than 10%, which is not preferable. Further, the cumulative strain at the three passes in the latter part in the finish rolling is greater than 0.6, the recrystallization of austenite occurs during the hot rolling, and thus the accumulated dislocation density at the time of the transformation is decreased. In this case, the ratio of the grains having the intragranular orientation difference in a range of 5° to 14° is less than 10%, and thus the aforementioned range is not preferable.

The cumulative strain (εeff.) at the three passes in the latter part in the finish rolling in the present embodiment can be obtained from the following Equation (1).

$$\epsilon eff. = \Sigma \epsilon i(t, T) \quad (1)$$

Here, $$\epsilon i(t, T) = \epsilon i0 / \exp\{(t/\kappa R)^{2/3}\},$$

$\kappa R = \kappa 0 \cdot \exp(Q/RT)$, $\kappa 0 = 8.46 \times 10^{-6}$,

Q=183200 J, and

R=8.314 J/K·mol,

εi0 represents a logarithmic strain at the time of rolling reduction, t represents a cumulative time immediately before the cooling in the pass, and T represents a rolling temperature in the pass.

The rolling finish temperature is preferably equal to or greater than Ar3+30° C. When the rolling finish temperature is lower than Ar3+30° C., in a case where ferrite is generated in a portion of the structure due to the unevenness of the composition in the steel sheet and rolling temperature, the ferrite may be processed. The deformed ferrite causes the ductility to be deteriorated, and thus is not preferable. In addition, when the rolling temperature is lower than Ar3+30° C., the ratio of the grains having the intragranular orientation difference in a range of 5° to 14° becomes excessive, which is not preferable.

Further, the hot rolling includes rough rolling and finish rolling, and the finish rolling is preferably performed using a tandem mill with which a plurality of mills are linearly arranged and continuously rolling in one direction so as to obtain a preferable thickness.

Ar3 can be calculated by the following Expression (2) based on the chemical composition of the steel sheet.

$$Ar3 = 901 - 325 \times [C] + 33 \times [Si] + 287 \times [P] + 40 \times [Al] - 92 \times ([Mn] + [Mo] + [Cu]) - 46 \times ([Cr] + [Ni]) \quad (2)$$

Here, [C], [Si], [P], [Al], [Mn], [Mo], [Cu], [Cr], and [Ni] each represent, by mass %, the amounts of each of C, Si, P, Al, Mn, Mo, Cu, Cr, and Ni. The elements which are not contained are calculated as 0%.

<Regarding Cooling Process>

After hot rolling, the hot-rolled steel sheet is cooled. In the cooling process, it is preferable that the hot-rolled steel sheet after completing the hot rolling is cooled (first cooling) down to a temperature range in a range of 650° C. to 750° C. at a cooling rate of equal to or greater than 10° C./s, and the hot-rolled steel sheet is held for 3 to 10 seconds in the temperature range, and thereafter, the hot-rolled steel sheet is cooled (second cooling) down to 100° C. at a cooling rate of equal to or greater than 30° C./s.

When the cooling rate in the first cooling is lower than 10° C./s, the transformation occurs in the para-equilibrium state at a temperature higher than a preferable temperature range, and thus the ratio of the grains having the intragranular orientation difference in a range of 5° to 14° becomes less than 10%, which is not preferable. In addition, when a cooling stopping temperature in the first cooling is lower than 650° C., the transformation occurs in the para-equilibrium state at a temperature lower than a preferable temperature range, and thus the ratio of the grains having the intragranular orientation difference in a range of 5° to 14° becomes less than 10%, which is not preferable. On the other hand, when the cooling stopping temperature in the first cooling is higher than 750° C., the transformation occurs in the para-equilibrium state at a temperature higher than a preferable temperature range, and thus the ratio of the grains having the intragranular orientation difference in a range of 5° to 14° becomes less than 10%, which is not preferable. In addition, even when a holding time is shorter than 3 seconds at a temperature range of 650° C. to 750° C., the ratio of the grains having the intragranular orientation difference in a range of 5° to 14° becomes less than 10%, which is not preferable. When the holding time at a temperature range of 650° C. to 750° C. is longer than 10 seconds, cementite harmful to the stretch flangeability is likely to occur, which is not preferable. In addition, when the cooling rate of the second cooling is lower than 30° C./s, cementite harmful to the stretch flangeability is likely to occur, which is not preferable. In addition, when the cooling stopping temperature of the second cooling is higher than 100° C., the martensite fraction is less than 2%, which is not preferable.

Although the upper limit of the cooling rate in the first cooling and the second cooling is not necessarily limited, the cooling rate may be set to be equal to or lower than 200° C./s in consideration of the equipment capacity of the cooling facility.

According to the above-described manufacturing method, it is possible to obtain a structure which includes, by area ratio, ferrite and bainite in a range of 80% to 98% in total, and martensite in a range of 2% to 10%, and in which the ratio of the grains having an intragranular orientation difference in a range of 5° to 14° is, by area ratio, in a range of 10% to 60%, when a boundary having an orientation difference of equal to or greater than 15° is defined as a grain boundary, and an area which is surrounded by the grain boundary and has an equivalent circle diameter of equal to or greater than 0.3 μm is defined as a grain.

In the aforementioned manufacturing method, it is important that processed dislocations are introduced into austenite by controlling the hot rolling conditions, and then the processed dislocations introduced by controlling the cooling conditions appropriately remain. That is, the hot rolling conditions and the cooling conditions each have an influence, it is important to control these conditions at the same time. A known method may be used for conditions other than the above-described ones, and there is no particular limitation.

In addition, there is no problem even if a heat treatment is performed as long as the area ratio of the above-mentioned structure can be kept.

EXAMPLES

Hereinafter, the present invention will be described more specifically with reference to examples of the hot-rolled steel sheet of the present invention; however, the present invention is not limited to Example described below, and can be implemented by being properly modified the extent that it can satisfy the object before and after description, which are all included in the technical range of the present invention.

In the present examples, first, the steel having the composition shown in the following Table 1 was melted so as to produce a slab, the slab was heated, and was subjected to hot and rough rolling, and subsequently, the finish rolling was performed under the conditions indicated in the following Table 2. The sheet thickness after the finish rolling was in a range of 2.2 to 3.4 mm. Ar3 (° C.) indicated in Table 2 was obtained from the composition shown in Table 1 using the following Expression (2).

$$Ar3=970-325\times[C]+33\times[Si]+287\times[P]+40\times[Al]-92\times([Mn]+[Mo]+[Cu])-46\times([Cr]+[Ni]) \quad (2)$$

In addition, the cumulative strains at the last three passes were obtained by the following Expression (1).

$$\epsilon eff.=\Sigma\epsilon i(t,T) \quad (1)$$

Here, $$\epsilon i(t,T)=\epsilon i0/\exp\{(t/\kappa R)^{2/3}\},$$

$\kappa R=\kappa 0\cdot\exp(Q/RT)$, $\kappa 0=8.46\times10^{-6}$,

Q=183200 J, and

R=8.314 J/K·mol, $\epsilon i0$ represents a logarithmic strain at the time of rolling reduction, t represents a cumulative time immediately before the cooling in the pass, and T represents a rolling temperature in the pass.

The blank column in Table 1 means that the analysis value was less than the detection limit.

TABLE 1

| | Chemical compositions (mass %, remainder: Fe and Impurities) | | | | | | | | | | | | | | | | | |
|---|---|---|---|---|---|---|---|---|---|---|---|---|---|---|---|---|---|---|
| Steel No. | C | Si | Mn | P | S | Al | Ti | Nb | Cr | N | V | Cu | Ni | Mo | Mg | Ca | REM | B |
| 1 | 0.042 | 0.026 | 1.05 | 0.013 | 0.002 | 0.21 | 0.100 | 0.017 | 0.10 | 0.0034 | | | | | | | | |
| 2 | 0.048 | 0.024 | 1.48 | 0.009 | 0.003 | 0.34 | 0.128 | 0.017 | 0.11 | 0.0027 | | | | | | | | |
| 3 | 0.066 | 0.029 | 1.07 | 0.017 | 0.002 | 0.30 | 0.105 | 0.018 | 0.10 | 0.0024 | | | | | | | | |
| 4 | 0.062 | 0.006 | 1.07 | 0.014 | 0.002 | 0.21 | 0.102 | 0.022 | 0.11 | 0.0033 | | | | | | | | |
| 5 | 0.028 | 0.022 | 1.07 | 0.012 | 0.003 | 0.30 | 0.099 | 0.022 | 0.09 | 0.0028 | | | | | | | | |
| 6 | 0.023 | 0.009 | 1.07 | 0.008 | 0.002 | 0.30 | 0.097 | 0.019 | 0.11 | 0.0028 | | | | | | | | |
| 7 | 0.049 | 0.076 | 1.03 | 0.015 | 0.003 | 0.26 | 0.097 | 0.017 | 0.12 | 0.0030 | | | | | | | | |
| 8 | 0.052 | 0.041 | 1.06 | 0.010 | 0.003 | 0.26 | 0.102 | 0.020 | 0.11 | 0.0030 | | | | | | | | |
| 9 | 0.041 | 0.027 | 1.94 | 0.015 | 0.002 | 0.20 | 0.099 | 0.022 | 0.10 | 0.0029 | | | | | | | | |
| 10 | 0.049 | 0.015 | 0.76 | 0.017 | 0.003 | 0.19 | 0.101 | 0.021 | 0.11 | 0.0031 | | | | | | | | |
| 11 | 0.052 | 0.021 | 0.62 | 0.016 | 0.003 | 0.30 | 0.104 | 0.020 | 0.11 | 0.0036 | | | | | | | | |
| 12 | 0.052 | 0.023 | 1.07 | 0.010 | 0.003 | 0.56 | 0.098 | 0.022 | 0.09 | 0.0034 | | | | | | | | |
| 13 | 0.046 | 0.029 | 1.01 | 0.012 | 0.003 | 0.48 | 0.105 | 0.021 | 0.11 | 0.0031 | | | | | | | | |
| 14 | 0.044 | 0.010 | 1.02 | 0.017 | 0.003 | 0.14 | 0.104 | 0.022 | 0.11 | 0.0025 | | | | | | | | |
| 15 | 0.044 | 0.035 | 1.01 | 0.016 | 0.002 | 0.12 | 0.099 | 0.020 | 0.12 | 0.0036 | | | | | | | | |
| 16 | 0.044 | 0.028 | 1.04 | 0.015 | 0.002 | 0.30 | 0.162 | 0.022 | 0.09 | 0.0034 | | | | | | | | |
| 17 | 0.044 | 0.013 | 1.06 | 0.008 | 0.002 | 0.26 | 0.148 | 0.018 | 0.12 | 0.0030 | | | | | | | | |
| 18 | 0.045 | 0.028 | 1.01 | 0.008 | 0.003 | 0.21 | 0.024 | 0.021 | 0.10 | 0.0025 | | | | | | | | |
| 19 | 0.050 | 0.033 | 0.98 | 0.013 | 0.002 | 0.27 | 0.016 | 0.020 | 0.12 | 0.0024 | | | | | | | | |
| 20 | 0.039 | 0.030 | 1.05 | 0.008 | 0.002 | 0.33 | 0.102 | 0.043 | 0.10 | 0.0035 | | | | | | | | |
| 21 | 0.043 | 0.033 | 0.99 | 0.009 | 0.002 | 0.23 | 0.099 | 0.032 | 0.11 | 0.0032 | | | | | | | | |
| 22 | 0.050 | 0.015 | 1.01 | 0.021 | 0.002 | 0.33 | 0.104 | 0.012 | 0.09 | 0.0033 | | | | | | | | |
| 23 | 0.043 | 0.010 | 1.01 | 0.021 | 0.002 | 0.27 | 0.103 | 0.008 | 0.11 | 0.0032 | | | | | | | | |
| 24 | 0.048 | 0.027 | 1.07 | 0.013 | 0.003 | 0.19 | 0.100 | 0.018 | | 0.0029 | | | | | | | | |
| 25 | 0.046 | 0.030 | 1.04 | 0.018 | 0.002 | 0.26 | 0.104 | 0.018 | 0.11 | 0.0024 | 0.106 | | | | | | | |
| 26 | 0.041 | 0.028 | 1.06 | 0.015 | 0.003 | 0.19 | 0.105 | 0.017 | 0.12 | 0.0030 | | 0.092 | | | | | | |
| 27 | 0.045 | 0.015 | 1.05 | 0.017 | 0.002 | 0.25 | 0.102 | 0.019 | 0.09 | 0.0033 | | | 0.129 | | | | | |
| 28 | 0.040 | 0.036 | 0.98 | 0.018 | 0.002 | 0.28 | 0.102 | 0.017 | 0.12 | 0.0030 | | | | 0.127 | | | | |
| 29 | 0.044 | 0.015 | 1.01 | 0.017 | 0.003 | 0.26 | 0.098 | 0.022 | 0.09 | 0.0027 | | | | | 0.002 | | | |
| 30 | 0.042 | 0.030 | 1.01 | 0.010 | 0.002 | 0.27 | 0.097 | 0.022 | 0.09 | 0.0033 | | | | | | 0.002 | | |
| 31 | 0.042 | 0.033 | 0.98 | 0.021 | 0.002 | 0.26 | 0.098 | 0.018 | 0.09 | 0.0026 | | | | | | | 0.002 | |
| 32 | 0.045 | 0.017 | 1.00 | 0.009 | 0.002 | 0.28 | 0.099 | 0.018 | 0.09 | 0.0024 | | | | | | | | 0.0013 |
| 33 | 0.076 | 0.021 | 1.02 | 0.011 | 0.003 | 0.34 | 0.104 | 0.020 | 0.10 | 0.0028 | | | | | | | | |
| 34 | 0.018 | 0.008 | 1.07 | 0.015 | 0.003 | 0.29 | 0.105 | 0.021 | 0.10 | 0.0029 | | | | | | | | |
| 35 | 0.046 | 0.549 | 0.99 | 0.014 | 0.002 | 0.19 | 0.100 | 0.020 | 0.10 | 0.0025 | | | | | | | | |
| 36 | 0.042 | 0.024 | 2.32 | 0.018 | 0.003 | 0.19 | 0.100 | 0.018 | 0.09 | 0.0026 | | | | | | | | |
| 37 | 0.040 | 0.013 | 0.50 | 0.018 | 0.002 | 0.21 | 0.100 | 0.018 | 0.12 | 0.0030 | | | | | | | | |
| 38 | 0.049 | 0.007 | 1.03 | 0.063 | 0.002 | 0.34 | 0.105 | 0.021 | 0.09 | 0.0032 | | | | | | | | |
| 39 | 0.051 | 0.015 | 1.01 | 0.015 | 0.006 | 0.33 | 0.101 | 0.022 | 0.12 | 0.0028 | | | | | | | | |
| 40 | 0.041 | 0.014 | 1.00 | 0.018 | 0.002 | 1.23 | 0.101 | 0.019 | 0.11 | 0.0026 | | | | | | | | |
| 41 | 0.052 | 0.024 | 1.01 | 0.008 | 0.003 | 0.09 | 0.104 | 0.021 | 0.12 | 0.0029 | | | | | | | | |
| 42 | 0.040 | 0.010 | 1.07 | 0.012 | 0.002 | 0.22 | 0.203 | 0.020 | 0.12 | 0.0035 | | | | | | | | |
| 43 | 0.050 | 0.013 | 0.99 | 0.021 | 0.002 | 0.30 | 0.010 | 0.020 | 0.10 | 0.0025 | | | | | | | | |
| 44 | 0.048 | 0.033 | 1.06 | 0.012 | 0.003 | 0.32 | 0.105 | 0.068 | 0.11 | 0.0027 | | | | | | | | |
| 45 | 0.050 | 0.014 | 0.99 | 0.009 | 0.002 | 0.33 | 0.103 | 0.004 | 0.09 | 0.0029 | | | | | | | | |
| 46 | 0.052 | 0.027 | 1.03 | 0.015 | 0.002 | 0.34 | 0.102 | 0.020 | 0.10 | 0.0069 | | | | | | | | |

TABLE 2

| Test No. | Steel No. | SRTmin (° C.) | Heating Temperature (° C.) | Ar3 (° C.) | Temperature after rolling (° C.) | Cumulative strains at least three passes after finish rolling (° C./s) | Cooling rate in first cooling (° C./s) | Cooling stopping temperature in first cooling (° C.) | Holding time at a temperature range of 650° C. to 750° C. (seconds) | Cooling rate in second cooling (° C./s) | Cooling stopping temperature in second cooling (° C.) |
|---|---|---|---|---|---|---|---|---|---|---|---|
| 1 | 1 | 1092 | 1225 | 799 | 885 | 0.58 | 55 | 730 | 6 | 37 | 70 |
| 2 | 2 | 1138 | 1212 | 761 | 895 | 0.54 | 63 | 684 | 5.2 | 48 | 43 |
| 3 | 3 | 1153 | 1236 | 794 | 895 | 0.53 | 47 | 707 | 5.4 | 54 | 59 |
| 4 | 4 | 1141 | 1237 | 790 | 885 | 0.57 | 56 | 704 | 5.2 | 39 | 61 |
| 5 | 5 | 1046 | 1233 | 805 | 906 | 0.53 | 51 | 704 | 6.5 | 46 | 50 |
| 6 | 6 | 1023 | 1218 | 805 | 893 | 0.53 | 34 | 715 | 5.6 | 43 | 41 |
| 7 | 7 | 1107 | 1213 | 802 | 884 | 0.53 | 41 | 724 | 5.9 | 53 | 46 |
| 8 | 8 | 1120 | 1232 | 796 | 899 | 0.56 | 71 | 707 | 5.7 | 46 | 54 |
| 9 | 9 | 1088 | 1216 | 718 | 895 | 0.53 | 72 | 712 | 5.7 | 37 | 42 |
| 10 | 10 | 1112 | 1227 | 823 | 881 | 0.55 | 41 | 721 | 5.9 | 53 | 38 |
| 11 | 11 | 1122 | 1231 | 839 | 892 | 0.55 | 32 | 715 | 6.3 | 50 | 58 |
| 12 | 12 | 1115 | 1229 | 808 | 891 | 0.57 | 51 | 718 | 5.2 | 57 | 46 |
| 13 | 13 | 1109 | 1216 | 812 | 892 | 0.55 | 36 | 719 | 5.2 | 49 | 43 |
| 14 | 14 | 1102 | 1238 | 799 | 902 | 0.55 | 49 | 728 | 5.6 | 49 | 49 |
| 15 | 15 | 1097 | 1217 | 799 | 893 | 0.55 | 49 | 704 | 6.3 | 46 | 46 |
| 16 | 16 | 1156 | 1226 | 804 | 895 | 0.55 | 49 | 702 | 5.7 | 44 | 47 |
| 17 | 17 | 1145 | 1223 | 797 | 886 | 0.54 | 33 | 728 | 6.4 | 58 | 40 |
| 18 | 18 | 952 | 1225 | 900 | 901 | 0.53 | 38 | 705 | 5.7 | 55 | 61 |
| 19 | 19 | 924 | 1236 | 805 | 882 | 0.58 | 55 | 706 | 5.4 | 55 | 41 |
| 20 | 20 | 1086 | 1221 | 804 | 884 | 0.53 | 36 | 702 | 6.5 | 41 | 73 |
| 21 | 21 | 1084 | 1218 | 904 | 885 | 0.53 | 40 | 700 | 6.4 | 35 | 33 |
| 22 | 22 | 1118 | 1232 | 807 | 885 | 0.53 | 68 | 704 | 5.5 | 40 | 69 |
| 23 | 23 | 1099 | 1217 | 805 | 889 | 0.56 | 71 | 711 | 6.5 | 53 | 35 |
| 24 | 24 | 1108 | 1218 | 799 | 909 | 0.57 | 35 | 716 | 5.9 | 35 | 75 |
| 25 | 25 | 1108 | 1238 | 802 | 893 | 0.57 | 69 | 711 | 5.8 | 41 | 53 |
| 26 | 26 | 1095 | 1228 | 789 | 896 | 0.53 | 50 | 703 | 6.3 | 38 | 49 |
| 27 | 27 | 1105 | 1235 | 795 | 888 | 0.55 | 36 | 700 | 6.6 | 36 | 48 |
| 28 | 28 | 1089 | 1217 | 798 | 909 | 0.53 | 88 | 702 | 5.6 | 47 | 47 |
| 29 | 29 | 1095 | 1234 | 805 | 886 | 0.55 | 41 | 708 | 5.9 | 53 | 68 |
| 30 | 30 | 1089 | 1215 | 805 | 901 | 0.54 | 71 | 724 | 6.6 | 68 | 45 |
| 31 | 31 | 1090 | 1235 | 811 | 903 | 0.54 | 66 | 714 | 6 | 41 | 76 |
| 32 | 32 | 1099 | 1219 | 805 | 902 | 0.58 | 26 | 707 | 5.4 | 40 | 67 |
| 34 | 1 | 1092 | 1219 | 799 | 826 | 0.56 | 81 | 729 | 5.6 | 46 | 65 |
| 35 | 1 | 1092 | 1230 | 799 | 903 | 0.65 | 45 | 710 | 5.7 | 45 | 59 |
| 36 | 1 | 1092 | 1235 | 799 | 888 | 0.48 | 70 | 700 | 5.6 | 46 | 40 |
| 37 | 1 | 1092 | 1214 | 799 | 887 | 0.53 | 8 | 707 | 5.2 | 48 | 71 |
| 38 | 1 | 1092 | 1213 | 799 | 910 | 0.58 | 47 | 783 | 6.2 | 49 | 61 |
| 39 | 1 | 1092 | 1210 | 799 | 899 | 0.58 | 37 | 642 | 6.4 | 41 | 38 |
| 41 | 1 | 1092 | 1237 | 799 | 899 | 0.58 | 31 | 729 | 2.4 | 44 | 47 |
| 43 | 1 | 1092 | 1217 | 799 | 882 | 0.53 | 41 | 720 | 5.3 | 54 | 239 |
| 44 | 33 | 1170 | 1222 | 795 | 894 | 0.54 | 63 | 718 | 5.3 | 49 | 52 |
| 45 | 34 | 1006 | 1228 | 808 | 909 | 0.58 | 30 | 714 | 6.1 | 42 | 52 |
| 46 | 35 | 1103 | 1236 | 820 | 882 | 0.58 | 69 | 719 | 6.6 | 34 | 59 |
| 47 | 36 | 1082 | 1233 | 684 | 891 | 0.55 | 52 | 701 | 5.4 | 48 | 50 |
| 48 | 37 | 1087 | 1236 | 850 | 894 | 0.54 | 30 | 712 | 5.4 | 50 | 44 |
| 49 | 38 | 1115 | 1236 | 818 | 883 | 0.53 | 36 | 710 | 6.5 | 53 | 58 |
| 50 | 39 | 1115 | 1212 | 804 | 895 | 0.54 | 71 | 720 | 5.2 | 36 | 50 |
| 51 | 40 | Cracks occur during rolling | | | | | | | | | |
| 52 | 41 | 1122 | 1217 | 792 | 903 | 0.55 | 54 | 713 | 6.1 | 48 | 38 |
| 53 | 42 | 1173 | 1221 | 797 | 896 | 0.57 | 70 | 717 | 5.8 | 44 | 52 |
| 54 | 43 | 884 | 1227 | 808 | 895 | 0.55 | 41 | 717 | 6.2 | 39 | 54 |
| 55 | 44 | 1114 | 1234 | 800 | 894 | 0.56 | 52 | 710 | 66 | 38 | 57 |
| 56 | 45 | 1116 | 1216 | 806 | 901 | 0.54 | 30 | 730 | 5.8 | 47 | 38 |
| 57 | 46 | 1120 | 1220 | 804 | 893 | 0.54 | 29 | 726 | 5.9 | 55 | 63 |

With respect to the obtained hot-rolled steel sheet, fraction of each structure (the area ratio), and the ratio of the grains having the intragranular orientation difference in a range of 5° to 14° were obtained. The structure fraction (the area ratio) was obtained using the following method. First, a sample collected from the hot-rolled steel sheet was etched using nital. After etching, a structure photograph obtained at a ¼ thickness position in a visual field of 300 μm×300 μm using an optical microscope was subjected to image analysis, and thereby the area ratio of ferrite and pearlite, and the total area ratio bainite and martensite were obtained. Then, with a sample etched by LePera solution, the structure photograph obtained at a ¼ thickness position in the visual field of 300 μm×300 μm using the optical microscope was subjected to the image analysis, and thereby the total area ratio of residual austenite and martensite was calculated.

Further, with a sample obtained by grinding the surface to a depth of ¼ thickness from in normal direction of the rolled surface, the volume fraction of the residual austenite was obtained through X-ray diffraction measurement. The volume fraction of the residual austenite was equivalent to the area ratio, and thus was set as the area ratio of the residual austenite.

With such a method, the area ratio of each of ferrite, bainite, martensite, residual austenite, and pearlite was obtained.

Further, the ratio of the grains having the intragranular orientation difference in a range of 5° to 14° was measured using the following method. First, regarding a vertical section in a rolling direction of a position of depth of ¼ (t/4 portion) thickness t from surface of the steel sheet, an area of 200 μm in the rolling direction, and 100 μm in the normal direction of the rolled surface was subjected to EBSD analysis at a measurement gap of 0.2 μm so as to obtain crystal orientation information. Here, the EBSD analysis was performed using an apparatus which is configured to include a thermal field emission scanning electron microscope (JSM-7001F, manufactured by JEOL) and an EBSD detector (HIKARI detector manufactured by TSL), at an analysis speed in a range of 200 to 300 points per second. Then, with respect to the obtained crystal orientation information, an area having the orientation difference of equal to or greater than 15° and an equivalent circle diameter of equal to or greater than 0.3 μm was defined as grain, an average intragranular orientation difference of the grains was calculated, and the ratio of the grains having the intragranular orientation difference in a range of 5° to 14° was obtained. The grain defined as described above and the average intragranular orientation difference can be calculated using software "OIM Analysis (trademark)" attached to an EBSD analyzer.

The results are indicated in Table 3. In Table 3, the structure other than ferrite, bainite, and martensite was pearlite or residual austenite. In addition, regarding Test No. 51, since cracking occurred during the rolling, it was not possible to conduct the subsequent test.

Next, in the tensile test, the tensile strength and elongation were obtained. In the present invention, the tensile strength properties (tensile strength (TS) and elongation (El)) among the mechanical properties were evaluated based on JIS Z 2241 (2011) using a test piece No. 5 of JIS Z 2241 (2011) which was collected in the longitudinal direction which is orthogonal to the rolling direction at a 1/4W position or 3/4W position in the sheet width. As a result of the test, when TS was equal to or greater than 540 MPa, it was determined that the strength was sufficient, and when TS×El was equal to or greater than 13500 MPa·%, it was determined that the ductility was sufficient.

The results are indicated in Table 4.

Next, the maximum forming height was obtained through the saddle type stretch flange test. In addition, a product of tensile strength (MPa) and maximum forming height (mm) was evaluated as an index of the stretch flangeability, and in a case where the product is equal to or greater than 19500 mm·MPa, it is determined that the steel sheet was excellent in the stretch flangeability. The saddle type stretch flange test was conducted by setting a clearance at the time of punching a corner portion to be 11% with a saddle-type formed product, as shown in FIG. 2 in which a radius of curvature R of a corner was set to 60 mm, and an opening angle θ was set to 120°. In addition, the existence of the cracks having a length of ⅓ of the sheet thickness were visually observed after forming, and then a forming height of the limit in which the cracks were not present was determined as the maximum forming height.

The results are indicated in Table 4.

Figure 3:
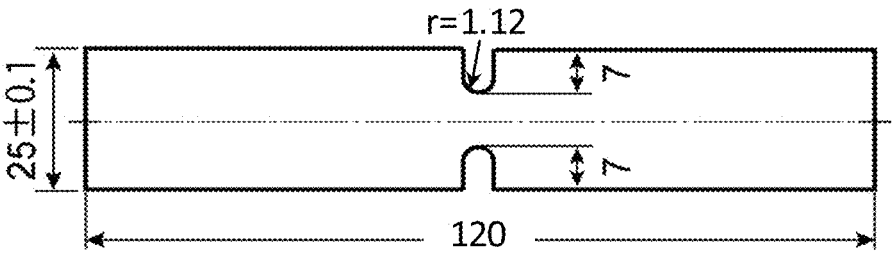
FIG. 3 is a diagram showing a shape of fatigue test piece used for evaluating the notch fatigue properties.

Next, in order to evaluate the notch fatigue properties in the direction orthogonal to the rolling direction, a fatigue test was conducted by collecting the fatigue test pieces formed into a shape as shown in FIG. 3 such that the direction orthogonal to the rolling direction from the same position as the position where tensile test pieces are collected becomes a long side. The fatigue test pieces shown in FIG. 3 are notch test pieces manufactured in order to obtain the fatigue strength of the notched material. The fatigue test pieces were ground to a depth of about 0.05 mm from the outermost layer. A stress control axial fatigue test was conducted under the conditions of stress ratio R=0.1 and a frequency of 5 Hz, the stress which was not broken after 10 million cycles was defined as notched fatigue limit (FL) and the notch fatigue properties were evaluated. As a result of test, in a case where the relationship of FL/TS≥0.25 was satisfied, it is determined that the notch fatigue properties were excellent. The results are indicated in Table 4.

Next, the chemical convertibility and the corrosion resistance after coating were evaluated.

Specifically, first, the manufactured steel sheet was performed pickling, after this the steel sheet was subjected to a phosphate chemical conversion treatment so as to adhere a zinc phosphate coated film of 2.5 g/m$^2$, and at this stage, measurement of existence of "SUKE" and a P ratio was performed as the evaluation the chemical convertibility. The "SUKE" mean the portions on which the chemical conversion coated film is not adhered, and the P ratio is a value indicated by P/(P+H), which is a ratio of X-ray diffraction intensity P of a phosphofilite (100) plane to X-ray diffraction intensity H of a Hopite (020) plane, measured using an X-ray diffraction apparatus.

The phosphate chemical conversion treatment is a treatment in which chemical solutions such as a phosphoric acid and Zn ions are used as main components, and is a chemical reaction to produce crystals called phosphofilite ($FeZn_2(PO_4)_2.4H_2O$) between Fe ions eluted from the steel sheet and the chemical solutions. In addition, technical points of the phosphate chemical conversion treatment are as follows:

(1) Fe ions are eluted so as to promote the react; and (2) Phosphofilite crystals are formed densely on the surface of the steel sheet.

Particularly, regarding (1), when oxides resulting from the formation of the Si scale remain on the surface of the steel sheet, since the elution of Fe is hindered, portions where the conversion coated film is not adhered called SUKE appear. Thus, an abnormal chemical conversion coated film which is not supposed to be formed on an iron surface called Hopite: $Zn_3(PO_4)_2.4H_2O$ may be formed and the performance after coating deteriorates. Accordingly, it is important to make the surface normal such that Fe on the surface of the steel sheet is eluted by phosphoric acid and thus Fe ions are sufficiently supplied.

The existence of the "SUKE" (non-coated portion) was determined through the observation using a scanning electron microscope. Specifically, the observation was performed at a magnification of 1,000-fold in about 20 visual fields, and a case where the coated film was evenly adhered to the entire surface and the "SUKE" (non-coated portions) were not confirmed is evaluated as "A" (none). In addition, a case where the visual fields in which the "SUKE" (non-coated portions) were confirmed were equal to or less than 5% is evaluated as "B" (slightly confirmed). A case where the visual fields in which the "SUKE" (non-coated portions) were confirmed were greater than 5% is evaluated as "C" (exist). In the case of C, it was determined that the chemical convertibility was deteriorated.

On the other hand, the P ratio can be measured using the X-ray diffraction apparatus. The ratio of X-ray diffraction intensity P of the phosphofilite (100) plane to the X-ray diffraction intensity H of Hopite (020) plane was obtained and evaluated as P ratio=P/(P+H). The P ratio indicates a proportion of hopite and phosphofilite in the coated film obtained through the chemical conversion, and thus as higher the P ratio, the more the phosphofilite, which means the phosphofilite crystals are densely formed on the surface of the steel sheet. Typically, a relationship of P ratio≥0.80 is required in order to satisfy the corrosion resistance performance and the coating performance, and in the corrosion strict environment such as a snow melting salt spray area, a relationship of P ratio≥0.85 is required. Accordingly, when the P ratio is less than 0.80, it was determined that the chemical convertibility was deteriorated. The results are indicated in Table 4.

Next, the corrosion resistance after coating was evaluated using the following methods.

First, the electrodeposition coating (thickness of 25 μm) was performed on the steel sheet after the chemical conversion, a coating and baking treatment was performed at 170° C. for 20 minutes, the electrodeposition coated film was cut with a sharp-pointed knife with a cut of 130 mm in length until it reached the base steel (base metal). In addition, 5% of salt spray was continuously performed on the steel sheet at a temperature of 35° C. for 700 hours under the salt spray conditions described in JIS Z 2371. After salt spray, a tape having a width of 24 mm (Nichiban 405 A-24 JIS Z 1522) was stuck on the notch portion in a length of 130 mm in parallel to the notch portion, and the maximum coat peeling width when the tape was peeled off was measured. When the maximum coat peeling width is greater than 4.0 mm, it was determined that the corrosion resistance after coating was degraded. The results are indicated in Table 4.

TABLE 3

| Test No. | Ferrite area ratio (%) | Bainite area ratio (%) | Total area ratio of ferrite and bainite (%) | Martensite area ratio (%) | Ratio of the grains having intragranular orientation difference in a range of 5° to 14° (%) | Tensile strength TS (MPa) | Ductility El (%) | Flange height H (mm) |
|---|---|---|---|---|---|---|---|---|
| 1 | 59 | 30 | 89 | 6 | 26 | 623 | 28.5 | 38.5 |
| 2 | 18 | 71 | 89 | 5 | 30 | 798 | 19.6 | 27.7 |
| 3 | 3 | 83 | 86 | 10 | 18 | 634 | 22.6 | 32.1 |
| 4 | 13 | 72 | 85 | 8 | 20 | 621 | 24.2 | 37.2 |
| 5 | 71 | 25 | 96 | 4 | 23 | 597 | 32.3 | 38.9 |
| 6 | 68 | 30 | 98 | 2 | 23 | 576 | 33.1 | 41.7 |
| 7 | 89 | 5 | 94 | 6 | 18 | 634 | 29.7 | 37.3 |
| 8 | 84 | 8 | 92 | 6 | 19 | 622 | 30.7 | 34.8 |
| 9 | 9 | 81 | 90 | 10 | 18 | 638 | 23.2 | 34 |
| 10 | 13 | 75 | 88 | 6 | 22 | 620 | 25.6 | 36.6 |
| 11 | 61 | 25 | 86 | 4 | 19 | 600 | 30.3 | 37.6 |
| 12 | 87 | 3 | 90 | 7 | 57 | 627 | 24.3 | 39.1 |
| 13 | 86 | 5 | 91 | 6 | 31 | 617 | 24.7 | 37.4 |
| 14 | 15 | 73 | 88 | 6 | 19 | 625 | 24.6 | 34.3 |
| 15 | 8 | 82 | 90 | 5 | 15 | 625 | 23 | 32.8 |
| 16 | 67 | 21 | 88 | 6 | 24 | 640 | 28.6 | 31.8 |
| 17 | 68 | 21 | 89 | 8 | 24 | 635 | 29.2 | 33 |
| 18 | 67 | 24 | 91 | 7 | 25 | 617 | 29.7 | 34.3 |
| 19 | 58 | 30 | 88 | 8 | 23 | 600 | 30.6 | 32.6 |
| 20 | 69 | 21 | 90 | 7 | 20 | 626 | 30.4 | 31.9 |
| 21 | 63 | 27 | 90 | 8 | 23 | 613 | 29.8 | 33.5 |
| 22 | 70 | 22 | 92 | 8 | 20 | 600 | 29.4 | 35.3 |
| 23 | 58 | 33 | 91 | 8 | 27 | 588 | 30.7 | 34.8 |
| 24 | 70 | 22 | 92 | 6 | 23 | 605 | 31 | 35.5 |
| 25 | 60 | 32 | 92 | 5 | 26 | 645 | 29.6 | 35.5 |
| 26 | 65 | 27 | 92 | 6 | 24 | 638 | 27.4 | 34.3 |
| 27 | 69 | 23 | 92 | 7 | 21 | 658 | 28.6 | 33.7 |
| 28 | 69 | 23 | 92 | 8 | 22 | 662 | 27.2 | 35 |
| 29 | 66 | 22 | 88 | 6 | 23 | 620 | 30.1 | 37.9 |
| 30 | 72 | 20 | 92 | 7 | 20 | 608 | 29.4 | 36 |
| 31 | 59 | 29 | 88 | 7 | 22 | 601 | 29.4 | 37.2 |
| 32 | 59 | 31 | 90 | 5 | 20 | 617 | 30.4 | 38.5 |
| 34 | 59 | 28 | 87 | 7 | 82 | 603 | 21.5 | 38.8 |
| 35 | 75 | 15 | 90 | 8 | 8 | 616 | 29.6 | 31.3 |
| 36 | 16 | 72 | 88 | 5 | 7 | 607 | 25.6 | 31.8 |
| 37 | 83 | 5 | 88 | 5 | 9 | 611 | 31.2 | 31.5 |
| 38 | 87 | 5 | 92 | 7 | 5 | 615 | 31.2 | 31.3 |
| 39 | 2 | 85 | 87 | 6 | 6 | 603 | 22.9 | 31.2 |
| 41 | 40 | 52 | 92 | 7 | 8 | 610 | 29.1 | 31.3 |
| 43 | 57 | 31 | 88 | 1 | 20 | 627 | 30.9 | 35.7 |
| 44 | 56 | 32 | 88 | 11 | 25 | 766 | 25.1 | 24.2 |
| 45 | 77 | 13 | 90 | 1 | 22 | 498 | 38.6 | 44.9 |
| 46 | 76 | 12 | 88 | 6 | 27 | 659 | 29.1 | 32.8 |
| 47 | 15 | 76 | 91 | 6 | 59 | 705 | 22.7 | 27.3 |
| 48 | 84 | 5 | 89 | 7 | 26 | 531 | 35.9 | 44.4 |
| 49 | 56 | 31 | 87 | 8 | 21 | 626 | 22 | 31.1 |
| 50 | 63 | 27 | 90 | 7 | 23 | 626 | 28.3 | 29.7 |
| 51 | | | | Cracks occur during rolling | | | | |
| 52 | 17 | 71 | 88 | 8 | 9 | 623 | 26.2 | 30.2 |
| 53 | 65 | 22 | 87 | 5 | 23 | 806 | 16.7 | 27 |
| 54 | 66 | 25 | 91 | 9 | 23 | 520 | 34.7 | 36.6 |
| 55 | 54 | 33 | 87 | 5 | 24 | 645 | 20.6 | 37.3 |
| 56 | 66 | 23 | 89 | 6 | 27 | 599 | 29.9 | 32 |
| 57 | 66 | 24 | 90 | 8 | 26 | 623 | 29.5 | 31 |

TABLE 4

| Test No. | TS × El (MPa · %) | TS × H (MPa · mm) | Notch fatigue limit FL (MPa) | FL/TS | Chemical convertibility: Existence of non-coated portion | Chemical convertibility: P ratio | Corrosion resistance after coating: Maximum coat peeling width (mm) | Remarks |
|---|---|---|---|---|---|---|---|---|
| 1 | 17756 | 23986 | 224 | 0.36 | A | 0.95 | 1.6 | Example of Present invention |
| 2 | 15641 | 22105 | 239 | 0.30 | A | 0.95 | 1.2 | Example of Present invention |
| 3 | 14328 | 20351 | 247 | 0.39 | A | 0.98 | 1.4 | Example of Present invention |
| 4 | 15028 | 23101 | 217 | 0.35 | A | 0.95 | 1.5 | Example of Present invention |
| 5 | 19283 | 23223 | 167 | 0.28 | A | 0.95 | 1.4 | Example of Present invention |
| 6 | 19066 | 24019 | 150 | 0.26 | A | 0.98 | 1.1 | Example of Present invention |
| 7 | 18830 | 23648 | 216 | 0.34 | A | 0.90 | 1.9 | Example of Present invention |
| 8 | 19095 | 21646 | 199 | 0.32 | B | 0.86 | 2.2 | Example of Present invention |
| 9 | 14802 | 21692 | 262 | 0.41 | A | 0.93 | 1.5 | Example of Present invention |
| 10 | 15872 | 22692 | 192 | 0.31 | A | 0.99 | 1.2 | Example of Present invention |
| 11 | 18180 | 22560 | 174 | 0.29 | A | 0.94 | 1.3 | Example of Present invention |
| 12 | 15236 | 24516 | 232 | 0.37 | A | 0.97 | 1.4 | Example of Present invention |
| 13 | 15240 | 23076 | 210 | 0.34 | A | 0.96 | 1.2 | Example of Present invention |
| 14 | 15375 | 21438 | 206 | 0.33 | A | 0.97 | 1.3 | Example of Present invention |
| 15 | 14375 | 20500 | 225 | 0.36 | A | 0.95 | 1.5 | Example of Present invention |
| 16 | 18304 | 20352 | 205 | 0.32 | A | 0.98 | 1.3 | Example of Present invention |
| 17 | 18542 | 20955 | 216 | 0.34 | A | 0.94 | 1.7 | Example of Present invention |
| 18 | 18325 | 21163 | 210 | 0.34 | A | 0.92 | 1.7 | Example of Present invention |
| 19 | 18360 | 19560 | 222 | 0.37 | A | 0.91 | 1.8 | Example of Present invention |
| 20 | 19030 | 19969 | 244 | 0.39 | A | 0.92 | 1.6 | Example of Present invention |
| 21 | 18267 | 20536 | 221 | 0.36 | A | 0.91 | 1.6 | Example of Present invention |
| 22 | 17640 | 21180 | 234 | 0.39 | A | 0.94 | 1.4 | Example of Present invention |
| 23 | 17990 | 20393 | 223 | 0.38 | A | 0.98 | 1.0 | Example of Present invention |
| 24 | 18755 | 21478 | 188 | 0.31 | A | 0.94 | 1.7 | Example of Present invention |
| 25 | 19092 | 22898 | 194 | 0.30 | A | 0.96 | 1.3 | Example of Present invention |
| 26 | 17481 | 21883 | 211 | 0.33 | A | 0.93 | 1.5 | Example of Present invention |
| 27 | 18819 | 22175 | 250 | 0.38 | A | 0.97 | 1.2 | Example of Present invention |
| 28 | 18006 | 23170 | 238 | 0.36 | A | 0.94 | 1.7 | Example of Present invention |
| 29 | 18662 | 23498 | 211 | 0.34 | A | 0.93 | 1.4 | Example of Present invention |
| 30 | 17875 | 21888 | 219 | 0.36 | A | 0.96 | 1.3 | Example of Present invention |
| 31 | 17669 | 22357 | 228 | 0.38 | A | 0.96 | 1.2 | Example of Present invention |
| 32 | 18757 | 23755 | 204 | 0.33 | A | 0.96 | 1.1 | Example of Present invention |
| 34 | 12965 | 23396 | 217 | 0.36 | A | 0.92 | 1.5 | Comparative Example |
| 35 | 18234 | 19281 | 222 | 0.36 | A | 0.98 | 1.4 | Comparative Example |
| 36 | 15539 | 19303 | 194 | 0.32 | A | 0.95 | 1.3 | Comparative Example |
| 37 | 19063 | 19247 | 196 | 0.32 | A | 0.93 | 1.6 | Comparative Example |
| 38 | 19188 | 19250 | 209 | 0.34 | A | 0.92 | 1.4 | Comparative Example |
| 39 | 13809 | 18814 | 211 | 0.35 | A | 0.95 | 1.6 | Comparative Example |
| 41 | 17751 | 19093 | 214 | 0.35 | A | 0.93 | 1.7 | Comparative Example |
| 43 | 19374 | 22384 | 150 | 0.24 | A | 0.98 | 1.0 | Comparative Example |
| 44 | 19227 | 18537 | 337 | 0.44 | A | 0.93 | 1.8 | Comparative Example |
| 45 | 19223 | 22360 | 115 | 0.23 | A | 0.94 | 1.7 | Comparative Example |
| 46 | 19177 | 21615 | 231 | 0.35 | C | 0.76 | 4.9 | Comparative Example |
| 47 | 16004 | 19247 | 226 | 0.32 | A | 0.98 | 1.2 | Comparative Example |
| 48 | 19063 | 23576 | 202 | 0.38 | A | 0.94 | 1.3 | Comparative Example |
| 49 | 13772 | 19469 | 232 | 0.37 | A | 0.95 | 1.4 | Comparative Example |
| 50 | 17716 | 18592 | 207 | 0.33 | A | 0.97 | 1.1 | Comparative Example |
| 51 | | | Cracks occur during rolling | | | | | Comparative Example |
| 52 | 16323 | 18815 | 218 | 0.35 | A | 0.94 | 1.7 | Comparative Example |
| 53 | 13460 | 21762 | 258 | 0.32 | A | 0.96 | 1.1 | Comparative Example |
| 54 | 18044 | 19032 | 213 | 0.41 | A | 0.94 | 1.4 | Comparative Example |
| 55 | 13287 | 24059 | 219 | 0.34 | A | 0.97 | 1.3 | Comparative Example |
| 56 | 17910 | 19168 | 216 | 0.36 | A | 0.98 | 1.0 | Comparative Example |
| 57 | 18379 | 19313 | 243 | 0.39 | A | 0.96 | 1.3 | Comparative Example |

As apparent from the results of Tables 3 and 4, in a case where the chemical composition defined in the present invention was hot-rolled under the preferable conditions (Test Nos. 1 to 32), it was possible to obtain a high-strength hot-rolled steel sheet which is excellent in stretch flangeability, the corrosion resistance after coating, and the notch fatigue properties, in which the strength is equal to or greater than 540 MPa, and an index of the stretch flangeability is equal to or greater than 19500 mm·MPa, TS×El is 13500 MPa·%, and a relationship of FL/TS 0.25 is satisfied, and a maximum coat peeling width is 4.0 mm.

On the other hand, Test Nos. 34 to 39, 41, and 43 are examples in which the manufacturing conditions were deviated from a preferable range, and thus any one or both of the structure observed using the optical microscope and the ratio of the grains having the intragranular orientation difference in a range of 5° to 14° did not satisfy the range of the present invention. In these examples, any one of the ductility, the stretch flangeability, and the notch fatigue properties did not satisfy the target value.

In addition, since Test Nos. 44 to 57 are examples in which the chemical composition was outside the range of the present invention, any one of the strength, the ductility, the stretch flangeability, and the notch fatigue properties did not satisfy the target value.

INDUSTRIAL APPLICABILITY

According to the present invention, it is possible to provide a high-strength hot-rolled steel sheet which has high strength and is excellent in the strict stretch flangeability, the notch fatigue properties, and the corrosion resistance after coating. The steel sheet contributes to improving fuel economy of vehicles, and thus has high industrial applicability.

What is claimed is:

1. A hot-rolled steel sheet comprising, as a chemical composition, by mass %, C: 0.020% to 0.070%,
Mn: 0.60% to 2.00%,
Al: 0.10% to 1.00%,
Ti: 0.015% to 0.170%,
Nb: 0.005% to 0.050%,
Cr: 0% to 1.0%,
V: 0% to 0.300%,
Cu: 0% to 2.00%,
Ni: 0% to 2.00%,
Mo: 0% to 1.00%,
Mg: 0% to 0.0100%,
Ca: 0% to 0.0100%,
REM: 0% to 0.1000%,
B: 0% to 0.0100%,
Si: limited to equal to or less than 0.100%,
P: limited to equal to or less than 0.050%,
S: limited to equal to or less than 0.005%, and
N: limited to equal to or less than 0.0060%,
with the remainder of Fe and impurities; and wherein a structure includes, by an area ratio, ferrite and bainite in a range of 80% to 98% in total, and martensite in a range of 2% to 10%, and wherein in the structure, in a case where a boundary having an orientation difference of equal to or greater than 15° is defined as a grain boundary, and an area which is surrounded by the grain boundary, and has an equivalent circle diameter of equal to or greater than 0.3 μm is defined as a grain, the ratio of the grains having an intragranular orientation difference in a range of 5° to 14° is, by the area ratio, in a range of 10% to 60%.

2. The hot-rolled steel sheet according to claim 1, wherein the chemical composition contains, by mass %, one or two or more of V: 0.010% to 0.300%,
Cu: 0.01% to 1.20%,
Ni: 0.01% to 0.60%, and
Mo: 0.01% to 1.00%.

3. The hot-rolled steel sheet according to claim 1 or 2, wherein the chemical composition contains, by mass %, one or two or more of Mg: 0.0005% to 0.0100%,
Ca: 0.0005% to 0.0100%, and
REM: 0.0005% to 0.1000%.

4. The hot-rolled steel sheet according to claim 3, wherein the chemical composition contains, by mass %, B: 0.0002% to 0.0020%.

5. The hot-rolled steel sheet according to claim 4, wherein a tensile strength is equal to or greater than 540 MPa, and a product of the tensile strength and a maximum forming height in a saddle type stretch flange test is equal to or greater than 19500 mm·MPa.

6. The hot-rolled steel sheet according to claim 3, wherein a tensile strength is equal to or greater than 540 MPa, and a product of the tensile strength and a maximum forming height in a saddle type stretch flange test is equal to or greater than 19500 mm·MPa.

7. The hot-rolled steel sheet according to claim 1 or 2, wherein the chemical composition contains, by mass %, B: 0.0002% to 0.0020%.

8. The hot-rolled steel sheet according to claim 7, wherein a tensile strength is equal to or greater than 540 MPa, and a product of the tensile strength and a maximum forming height in a saddle type stretch flange test is equal to or greater than 19500 mm·MPa.

9. The hot-rolled steel sheet according to claim 1 or 2, wherein a tensile strength is equal to or greater than 540 MPa, and a product of the tensile strength and a maximum forming height in a saddle type stretch flange test is equal to or greater than 19500 mm·MPa.

10. A hot-rolled steel sheet comprising, as a chemical composition, by mass %, C: 0.020% to 0.070%,
Mn: 0.60% to 2.00%,
Al: 0.10% to 1.00%,
Ti: 0.015% to 0.170%,
Nb: 0.005% to 0.050%,
Cr: 0% to 1.0%,
V: 0.010% to 0.300%,
Cu: 0.01% to 1.20%,
Ni: 0.01% to 0.60%,
Mo: 0.01% to 1.00%,
Mg: 0.0005% to 0.0100%,
Ca: 0.0005% to 0.0100%,
REM: 0.0005% to 0.1000%,
B: 0.0002% to 0.0020%,
Si: limited to equal to or less than 0.100%,
P: limited to equal to or less than 0.050%,
S: limited to equal to or less than 0.005%, and
N: limited to equal to or less than 0.0060%,
with the remainder of Fe and impurities; and wherein a structure includes, by an area ratio, ferrite and bainite in a range of 80% to 98% in total, and martensite in a range of 2% to 10%, and wherein in the structure, in a case where a boundary having an orientation difference of equal to or greater than 15° is defined as a grain boundary, and an area which is surrounded by the grain boundary, and has an equivalent circle diameter of equal to or greater than 0.3 μm is defined as a grain, the ratio of the grains having an intragranular orientation difference in a range of 5° to 14° is, by the area ratio, in a range of 10% to 60%.

* * * * *